US010893714B2

(12) United States Patent
Zimmermann et al.

(10) Patent No.: US 10,893,714 B2
(45) Date of Patent: Jan. 19, 2021

(54) CLOSURE DEVICE FOR CONNECTING TWO PARTS

(71) Applicant: Fidlock GmbH, Hannover (DE)

(72) Inventors: Lasse Zimmermann, Hannover (DE); Breido Botkus, Hannover (DE); Joachim Fiedler, Hannover (DE)

(73) Assignee: Fidlock GmbH, Hannover (DE)

( * ) Notice: Subject to any disclaimer, the term of this patent is extended or adjusted under 35 U.S.C. 154(b) by 0 days.

(21) Appl. No.: 16/334,947

(22) PCT Filed: Sep. 21, 2017

(86) PCT No.: PCT/EP2017/073898

§ 371 (c)(1),
(2) Date: Mar. 20, 2019

(87) PCT Pub. No.: WO2018/055033

PCT Pub. Date: Mar. 29, 2018

(65) Prior Publication Data

US 2019/0261712 A1 Aug. 29, 2019

(30) Foreign Application Priority Data

Sep. 22, 2016 (DE) ..... 10 2016 218 267

(51) Int. Cl.
*A41F 1/00* (2006.01)
*A44B 18/00* (2006.01)
*A44B 99/00* (2010.01)

(52) U.S. Cl.
CPC ..... *A41F 1/002* (2013.01); *A41F 1/006* (2013.01); *A44B 18/0007* (2013.01); *A44B 99/00* (2013.01); *Y10T 24/32* (2015.01)

(58) Field of Classification Search
CPC ..... A41F 1/002; A41F 1/006; Y10T 24/32; A44B 18/0007; A44B 99/00
See application file for complete search history.

(56) References Cited

U.S. PATENT DOCUMENTS 2,461,201 A * 2/1949 Ellis ..... A41F 1/002 2/311
2,717,437 A 9/1955 De Mestral
(Continued)

FOREIGN PATENT DOCUMENTS

CH 295638 3/1954
CN 102202533 A 9/2011
(Continued)

*Primary Examiner* — Robert Sandy
*Assistant Examiner* — Michael S Lee
(74) *Attorney, Agent, or Firm* — The Webb Law Firm

(57) ABSTRACT

A closure device for connecting two parts includes a first closure part which includes a first surface with an arrangement of first structure elements arranged thereon and a second closure part which includes a second surface with an arrangement of second structure elements arranged thereon. The first closure part and the second closure part are to be positioned together in such a manner that the first surface of the first closure part faces the second surface of the second closure part such that the first structure elements and the second structure elements engage in one another in such a manner that movement of the closure parts relative to one another along a load direction is blocked.

18 Claims, 18 Drawing Sheets

(56) References Cited

U.S. PATENT DOCUMENTS

| | | | | |
|---|---|---|---|---|
| 3,102,314 | A | 9/1963 | Alderfer | |
| 3,748,697 | A | 7/1973 | Marchese et al. | |
| 3,922,455 | A | 11/1975 | Brumlik | |
| 3,981,051 | A | 9/1976 | Brumlik | |
| 4,197,618 | A | 4/1980 | Bourguignon | |
| 4,875,259 | A | 10/1989 | Appeldorn | |
| 5,179,767 | A | 1/1993 | Allan | |
| 5,208,952 | A | 5/1993 | Mintel et al. | |
| 5,212,853 | A | 5/1993 | Kaneko | |
| 5,634,245 | A | 6/1997 | Rouser et al. | |
| 5,945,193 | A | 8/1999 | Pollard et al. | |
| 5,983,467 | A | 11/1999 | Duffy | |
| 6,085,394 | A | 7/2000 | Hartman | |
| 6,301,754 | B1 * | 10/2001 | Grunberger | A41F 1/002 24/303 |
| 6,432,339 | B1 | 8/2002 | Jens et al. | |
| 6,434,801 | B2 | 8/2002 | Grunberger | |
| 6,463,635 | B2 | 10/2002 | Murasaki | |
| 6,911,171 | B2 | 6/2005 | Lauer | |
| 6,913,810 | B2 | 7/2005 | Wang et al. | |
| 7,478,460 | B2 | 1/2009 | Gallant et al. | |
| 9,721,712 | B2 * | 8/2017 | Provencher | H01F 7/0263 |
| 2010/0101058 | A1 | 4/2010 | Fildan et al. | |
| 2011/0041294 | A1 | 2/2011 | Ehring et al. | |
| 2013/0061431 | A1 | 3/2013 | Naftali et al. | |
| 2019/0343239 | A1 * | 11/2019 | Fiedler | A44B 11/258 |

FOREIGN PATENT DOCUMENTS

| | | | |
|---|---|---|---|
| CN | 103237473 | A | 8/2013 |
| DE | 202009006189 | U1 | 10/2010 |
| EP | 0922399 | A2 | 6/1999 |

* cited by examiner

CLOSURE DEVICE FOR CONNECTING TWO PARTS

CROSS-REFERENCE TO RELATED APPLICATIONS

This application is the United States national phase of International Application No. PCT/EP2017/073898 filed Sep. 21, 2017, and claims priority to German Patent Application No. 10 2016 218 267.6 filed Sep. 22, 2016, the disclosures of which are hereby incorporated by reference in their entirety.

BACKGROUND OF THE INVENTION

Field of the Invention

The disclosure relates to a closure device for connecting two parts.

Description of Related Art

Such a closure device includes a first closure part which comprises a first surface with an arrangement of first structure elements arranged thereon and a second closure part which comprises a second surface with an arrangement of second structure elements arranged thereon. The first closure part and the second closure part are to be positioned together in such a manner that the first surface of the first closure part faces the second surface of the second closure part such that the first structure elements and the second structure elements engage in one another in such a manner that movement of the closure parts relative to one another along a load direction is blocked.

Such a closure device can be used, for example, on textile articles, for example items of clothing, for example a bra. The closure device can also be used, however, for connecting other parts, for example as a closure for a bag, a rucksack, a case or another type of receptacle or, for example, also for a protective vest, for example a life jacket or the like.

In the case of a closure device disclosed in U.S. Pat. No. 7,478,460, closure parts comprise a surface structure with arcuate elements. By positioning the closure parts together, the circular elements move into engagement with one another such that the closure parts are held together.

In the case of a closure device disclosed in U.S. Pat. No. 5,983,467, closure parts comprise structure elements in the form of, for example, mushroom-shaped projections which can lock together in order to bring about a hold between the closure parts in this way.

It is desirable in the case of a closure device which can be used, for example, as a closure for a textile garment (in the manner of a Velcro fastener), for loads in particular under tension to be able to be absorbed in a favorable, reliable manner. In this case, the closure device is to be closed in a simple manner and also opened again in a simple manner and in the case of load, however, is to be able to withstand high forces. Variable applicability with cost-efficient production is also desirable.

SUMMARY OF THE INVENTION

An object underlying the proposed solution is to provide a closure device which is suitable to absorb loads under tension and at the same time is simple to close and also simple to open again.

Said object is achieved by a closure device with features as described herein.

Accordingly, the first closure part comprises a first arrangement of magnets with a plurality of magnetic poles which are offset in relation to one another along the first surface and the second closure part comprises a second arrangement of magnets with a plurality of magnetic poles which are offset in relation to one another along the second surface.

The closure device can be closed by positioning the closure parts thereof together. Each closure part comprises on the surface thereof an arrangement of structure elements which move into engagement with one another when the closure parts are positioned such that the closure parts are fixed together so as to be loadable under tension. The load direction, in this connection, is in the plane of the surfaces of the closure parts. The load is consequently effected along a direction tangentially to the surfaces.

The closure parts extend in each case flatly with the surfaces thereof. The closure parts, in this connection, may be flexible at least in portions and the form thereof is consequently able to be adapted, for example curved, in a flexible manner.

The engagement between the arrangements of the structure elements on the surfaces of the closure parts is effected, in this connection, on account of magnetic interaction between the closure parts. For this purpose, an arrangement of magnets with a plurality of magnetic poles is arranged on each closure part, the arrangements of magnets being located opposite one another in a magnetically attracting manner when closed and when the closure parts are positioned together (with unlike magnetic poles facing one another in a complete or at least partial manner). The closing of the closure device is consequently simple on account of the magnetic interaction and, in addition, when the closure parts are positioned together, the structure elements of the closure parts are held magnetically in engagement such that the hold of the closure parts together is secured in a magnetic manner.

The magnetic poles of each arrangement of magnets are offset to one another along the surface of the assigned closure part. The arrangement of magnets is consequently multipolar and points with multiple different magnetic poles (north poles and south poles) toward the arrangement of magnets of the respectively other closure part, with the closure parts positioned together and the closure device closed, unlike magnetic poles of the arrangements of magnets of the closure parts facing one another in an attracting manner.

The multipolar arrangement of magnets can in particular also cause the closure parts to be able to be positioned together in a limited number of discrete positions. Said discrete positions are predefined by such positions in which the arrangements of magnets of the closure parts face one another in a magnetically attracting manner, unlike magnetic poles of the arrangements of magnets are consequently situated opposite one another.

For opening, the closure parts, for example, can simply be pulled apart from one another, as a result of which the structure elements of the closure parts move out of engagement with one another. It can be conceivable and possible for the closure parts to be moved relative to one another in opposition to the load direction for opening, as a result of which, with corresponding polarity of the arrangement of magnets, for example, like poles of the arrangement of magnets can be caused to move closer together and consequently the closure parts mutually to repel one another as a result of said tangential opening movement. This can contribute to the closure device being opened in a particularly easy, haptically pleasant manner.

In one design, the closure parts are realized hermaphroditically and, in each case, comprise identical arrangements of structure elements. The first structure elements of the first closure part correspond in form (and where applicable also in arrangement) consequently to the second structure elements of the second closure part. In particular the first structure elements can protrude from the surface of the first closure part and the second structure elements can protrude from the surface of the second closure part and be realized consequently as protruding engagement projections.

With the closure device in the closed position, the first structure elements of the first closure part and the second structure elements of the second closure part engage in one another. In principle, the structure elements can be realized completely differently by arbitrarily formed projection elements or by an arbitrary structural shaping on the surface. For example, the arrangement of structure elements can also be formed by roughening as a result of irregularly formed, where applicable microscopically small, mountains and valleys on the surface of the assigned closure part. As a result of the arrangement of first structure elements on the first surface of the first closure part and as a result of the arrangement of second structure elements on the second surface of the second closure part, a structure form, which is designed for engagement with the structure form of the respectively other surface and, with the closure device in the closed position, creates a connection which is loadable under tension, is created on the respective surface.

In one design, the first structure elements comprise first blocking faces and the second structure elements comprise second blocking faces. With the closure parts positioned together, the structure elements face one another with the blocking faces thereof such that when the closure parts are loaded in the load direction, the blocking faces move to abut against one another and in this way movement of the closure parts relative to one another in the load direction is blocked.

The blocking faces can extend, for example, as faces which are oriented perpendicularly to the surface.

As an alternative to this, the blocking faces can also realize undercuts and for this purpose extend at an (acute) angle to the surface.

Other undercut geometries on the structure elements are also conceivable and possible in this connection. The structure elements can thus comprise latching lugs or webs or the like which can be moved into engagement with one another.

Movement of the closure parts relative to one another in the load direction is blocked by means of the blocking faces. The closure parts cannot be moved tangentially to one another in the load direction such that tension forces at the closure parts can be absorbed and consequently, with the closure parts positioned together, a loadable connection is created in the load direction.

It is conceivable and possible in this connection for the connection to be loadable under tension not only in the load direction but also in opposition to the load direction. For this purpose, the first structure elements can comprise a further blocking face in each case on a side remote from the first blocking face, and equally the second structure elements can comprise a further blocking face in each case on a side remote from the second blocking face. When the load is in opposition to the load direction, the structure elements move via the further blocking faces thereof to abut against one another such that the connection between the closure parts is also secured in opposition to the load direction.

In another design, however, it can also be provided that the closure parts can be moved in relation to one another in opposition to the load direction, for example in order to adapt the closure position of the closure parts to one another and, for example, to tension the closure device. For this purpose, the first structure elements can comprise first run-on surfaces and the second structure elements can comprise second run-on surfaces, wherein the first structure elements and the second structure elements run onto one another by way of the run-on surfaces thereof when the closure parts are loaded in opposition to the load direction. The first structure elements consequently point with the blocking faces thereof in the load direction, whilst they point with the run-on surfaces in opposition to the load direction. The run-on surfaces can extend, for example, at an angle to the surface of the assigned closure part and realize ramps which run onto one another when the closure parts move in relation to one another in opposition to the load direction.

By means of such run-on surfaces, a type of mechanical freewheeling can be created in opposition to the load direction. Whereas the closure parts block one another when there is a tensile load in the load direction, the structure elements of the closure parts, when there is a load in opposition to the load direction, can slide over one another as a result of running onto the run-on surfaces such that the position of the closure parts in relation to one another can be adapted in opposition to the load direction.

The first structure elements and/or the second structure elements can each comprise, for example, in a top view of the respective surface, a curved form or a V form. The structure elements can be shaped, for example, arcuately or in a V.

The tip of the V form can point, for example, in the load direction. The structure elements of a closure part can be separated from one another transversely to the load direction, it also being conceivable and possible to connect multiple structure elements together transversely to the load direction, for example for realizing a zigzag line or a curved line. Advantageous flexibility at the respective closure part can be obtained, for example, by separating the structure elements from one another.

In one design, the structure elements can each comprise, for example, at least one leg which extends along the assigned surface and is aligned at a slanted angle to the load direction. If the structure elements are V-shaped, each structure element can thus comprise, for example, two legs which are aligned at an angle, in particular an obtuse angle, to one another. As a result of the V-shaped design, the engagement between the structure elements may be self-enforcing by the first structure elements on the first surface of the first closure part being pulled into engagement with the second structure elements on the second surface of the second closure part when there is load in the load direction and as a result of the engagement of the V form, the structure elements are in particular not able to be displaced relative to one another transversely to the load direction either.

The first structure elements can be arranged, for example, in a grid-shaped manner on the first surface of the first closure part, whilst the second structure elements are arranged in a grid-shaped manner on the second surface of the second closure part. Thus, the first structure elements on the first surface can be arranged in rows offset to one another along the load direction, whilst the second structure elements are arranged analogously in rows on the second surface. In this connection, the structure elements of adjacent rows, when viewed transversely to the load direction, can be non-offset to one another. Or the structure elements of adjacent rows can be offset to one another by (precisely) half the width of a structure element, measured transversely to the load direction.

The first arrangement of magnets of the first closure part and the second arrangement of magnets of the second closure part are each realized with multiple magnetic poles which are offset to one another along the surface of the respectively assigned closure part. Each arrangement of magnets, in this connection, can be realized by an arrangement of (discrete) permanent magnetic elements which are inserted, for example, in an indentation of the closure part provided for this purpose and consequently point toward the surface of the assigned closure part with different poles. However, it is also conceivable and possible to realize each closure part with a multipolar permanent magnetic film, it being possible to glue or weld such a permanent magnetic film to a body realizing the surface on the rear side of the structure elements or also to realize the body itself by such a permanent magnetic film, on the surface of which the structure elements are directly integrally molded.

The permanent magnetic elements can be realized, for example, as neodymium magnets. A permanent magnetic film, for example, is a plastic bonded, flexible, permanently magnetic film which can include, for example, a magnetic powder with a proportion of neodymium.

The magnetic poles of the first arrangement of magnets and/or the magnetic poles of the second arrangement of magnets may be arranged together in rows periodically. The magnetic poles consequently realize an arrangement, with, for example, magnetic poles which are arranged together in rows and are offset to one another along the load direction and/or transversely to the load direction.

In one design, the magnetic poles of the first arrangement of magnets and/or the magnetic poles of the second arrangement of magnets can be arranged together in rows along the load direction. North pole and south pole are consequently arranged together in rows in an alternating manner along the load direction such that a (periodic) sequence is produced. Discrete positions for connecting the closure parts together, in which the magnetic poles of the first closure part and the magnetic poles of the second closure part face one another precisely in an attracting manner, can be predefined in this way so that the closure parts are pulled magnetically toward one another and the structure elements of the closure parts move into engagement with one another.

The first structure elements and/or the second structure elements may comprise a first periodicity and the magnetic poles of the first arrangement of magnets and/or the magnetic poles of the second arrangement of magnets comprise a second periodicity, in each case viewed along the load direction. The first periodicity, in this connection, can correspond to the second periodicity or to a whole number multiple of the second periodicity. If, for example, the structure elements of the first closure part and the structure elements of the second closure part are arranged with the identical (first) periodicity and if this corresponds to the second periodicity, with which the magnetic poles of the first arrangement of magnets and the second arrangement of magnets are arranged with respect to one another, a discrete number of positions can thus be predefined by the magnetic poles in which the closure parts can be positioned together and precisely by way of the structure elements thereof move into engagement with one another. The magnetic attraction between the closure parts consequently brings about a positioning precisely in such a manner that the structure elements move reliably into engagement with one another and the closure device consequently closes in a reliable manner.

If the first periodicity corresponds to the second periodicity or to a whole number multiple of the second periodicity, simple opening or, where applicable, a type of magnetic freewheeling can thus also be provided as a result. It can thus be provided that in the event of the closure parts being loaded in relation to one another in opposition to the load direction, the closure parts are displaced in relation to one another in opposition to the load direction, as a result of which the arrangements of the magnets of the closure parts with like poles are moved closer to one another and consequently mutually repel each other such that particularly simple opening of the closure device can be achieved. In this way, as a result of magnetic repulsion when the closure parts move in relation to one another in opposition to the load direction, structure elements can be jumped over such that when the closure parts move in relation to one another in opposition to the load direction, the structure elements do not move into engagement with one another. In the case of such magnetic freewheeling, designing the structure elements in a ramp-shaped manner by providing corresponding run-on faces is not necessary.

The first closure part and the second closure part are displaceable in relation to one another such as by a release travel in opposition to the load direction for providing magnetic freewheeling. In the case of displacement by the release travel, the arrangements of magnets of the closure parts with like poles move to face one another and as a result repel each other (the arrangements of magnets reverse polarity in relation to one another). The structure elements on the surfaces are arranged, in this connection, in such a manner with respect to one another that when being displaced by the release travel, each structure element of a closure part does not strike against the other closure part on the structure element following in opposition to the load direction.

The release travel may correspond to half the periodicity of the arrangements of magnets along the load direction.

The arrangements of magnets of the closure parts may be arranged in rows together and positioned in precisely such a manner along the load direction that when the closure parts are positioned together, the structure elements are reliably able to move into engagement with one another, in this case however not yet abutting against one another by way of the blocking faces thereof. Once positioned, the closure parts consequently comprise a certain play in relation to one another in the load direction and are not (yet) secured, in this case, in relation to one another in particular transversely to the load direction such that the closure parts are able to be displaced in relation to one another transversely to the load direction. This can enable simple opening as a result of displacing the closure parts transversely in relation to one another. Under load, the structure elements then move into engagement with the blocking faces abutting against one another, as a result of said abutment, in particular where the structure elements are designed in a V-shaped manner, transverse displacement of the closure parts in relation to one another also being blocked.

In addition to or as an alternative to the mounting in rows along the load direction, the magnetic poles of the first arrangement of magnets and the magnetic poles of the second arrangement of magnets can also be mounted in rows together along a transverse direction which extends transversely to the load direction. Discrete positions for connecting the closure parts, which are offset to one another transversely to the load direction, can be predefined in this manner. Said arrangement of magnetic poles is, for example, also advantageous in connection with the afore-described "mechanical freewheeling" because said positioning of the magnetic poles in rows brings about a positioning action transversely to the load direction during adjustment in opposition to the load direction.

In one design, magnetic poles are positioned in rows together both in the load direction and transversely to the load direction such that a two-dimensional grid of alternating magnetic poles (north pole and south pole) is produced.

The object is also achieved by a closure device for connecting two parts, which device includes a first closure part with a first surface with an arrangement of first structure elements arranged thereon and a second closure part with a second surface with an arrangement of second structure elements arranged thereon. The first closure part and the second closure part are to be positioned together in such a manner that the first surface of the first closure part faces the second surface of the second closure part such that the first structure elements and the second structure elements engage in one another in such a manner that a movement of the closure parts relative to one another along a load direction is blocked. It is provided in this case that the first closure part comprises a first arrangement of magnets and the second closure part comprises a second arrangement of magnets, wherein the first arrangement of magnets and/or the second arrangement of magnets are formed at least in portions by a permanent magnetic film.

The advantages and advantageous designs depicted above are also applicable in an entirely analogous manner to said closure device. In particular, the features of all the subclaims are also combinable with said closure device.

A closure device of the type described above can be used in particular for a textile closure, that is to say a closure for connecting textile parts, in particular in the case of garments. Jackets, belts, shoes or other items of clothing, for example also a bra, can be closed by means of such a textile closure.

BRIEF DESCRIPTION OF THE DRAWINGS

The concept on which the solution is based is to be explained in more detail below by way of the exemplary embodiments shown in the figures, in which.

DESCRIPTION OF THE INVENTION

Figure 1:
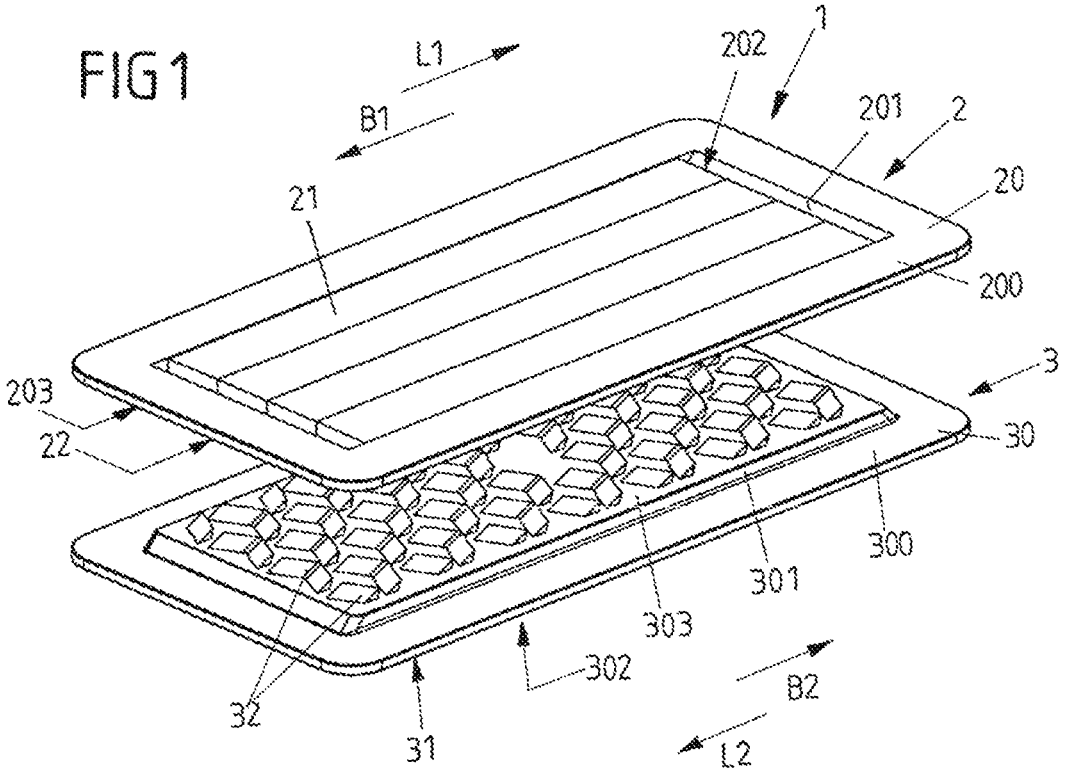
FIG. 1 shows a perspective view of a closure device with two closure parts.

FIG. 1 shows an exemplary embodiment of a closure device 1 which comprises a first flatly extending closure part 2 and a second flatly extending closure part 3. The closure device 1 can be used, for example, as a closure on a garment (for example on a jacket), on a receptacle (for example on a bag or on a rucksack) or on a vest (for example a protective vest, a life jacket or the like).

Each closure part 2, 3 comprises a body 20, 30 with a circumferential edge 200, 300 and a raised portion 201, 301 which protrudes in relation to the edge 200, 300. A surface 203, 303, on which structure elements 22, 32 of identical form are arranged, is formed on the raised portion 201, 301.

The closure parts 2, 3 can be positioned together by way of the surfaces 203, 303 thereof and as a result move into engagement with one another by way of the structure elements 22, 32. An arrangement of magnets 21, 31, which causes the closure parts 2, 3, when positioned together, to be pulled magnetically toward one another and to be held magnetically on one another in a position positioned together, is received, in this connection, on each closure part 2, 3 in an indentation 202, 302 formed on the rear of the raised portion 201, 301.

Figure 2:
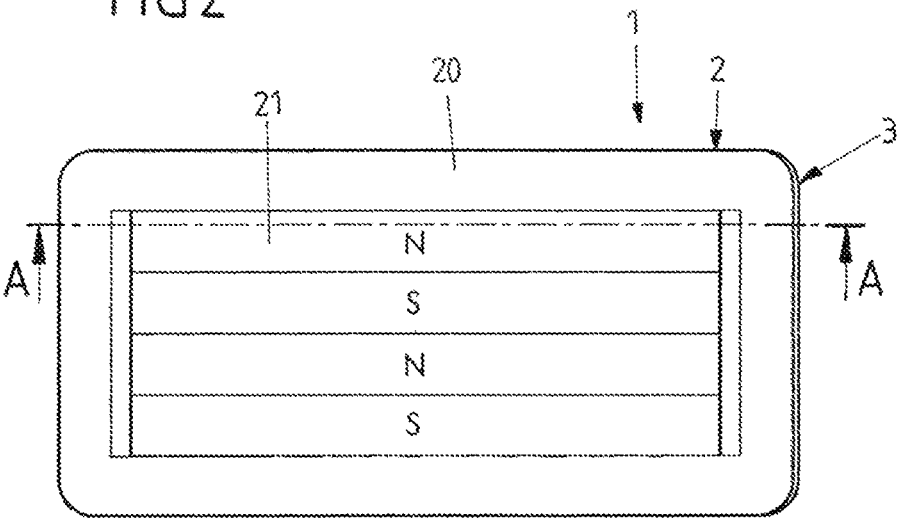
FIG. 2 shows a top view of the arrangement according to FIG. 1.
Figure 3A:
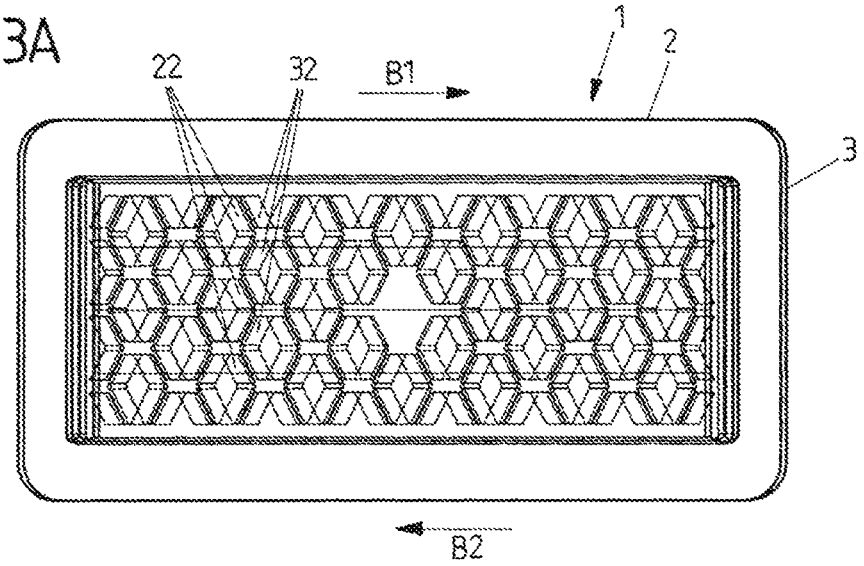
FIG. 3A shows a view through the arrangement according to FIG. 2.
Figure 3B:
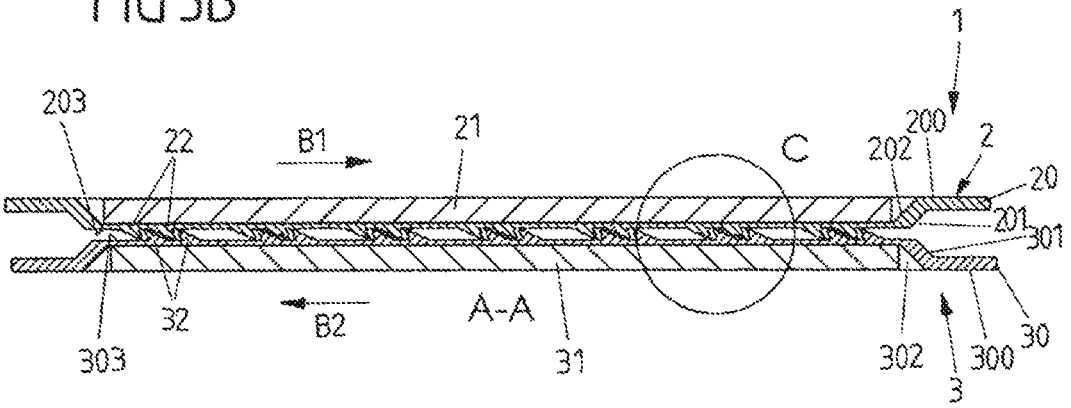
FIG. 3B shows a sectional view along the line A-A according to FIG. 2.
Figure 3C:
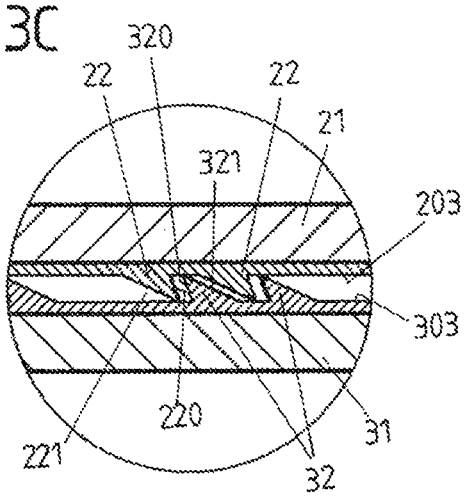
FIG. 3C shows an enlarged representation of the detail C according to FIG. 3B.

FIG. 2 shows a top view of the arrangement according to FIG. 1. FIGS. 3A to 3C show the closure device 1 in a closed position and FIGS. 4A to 4C when it is displaced in opposition to the load direction B1, B2.

Figure 3D:
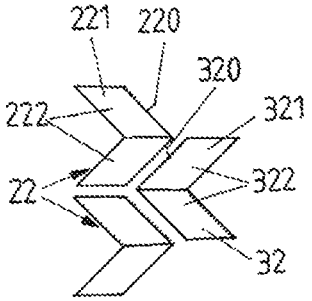
FIG. 3D shows a schematic view of structure elements of the closure parts.

The structure elements 22, 32 on the surfaces 203, 303 of the closure parts 2, 3 each comprise a V-shaped design, with legs 222, 322 which are aligned with respect to one another at an obtuse angle, as is shown schematically in FIG. 3D. In cross section, shown in FIG. 3C and FIG. 4C, the structure elements 22, 32 each comprise a saw-tooth form, with blocking faces 220, 320, which extend at an acute angle to the surface 203, 303, on a first side of the legs 222, 232 which realize an undercut with the surface 203, 303, and run-on surfaces 221, 321 on the other side of the legs 222, 232 which extend at an obtuse angle to the surface 203, 303 and in each case realize a ramp.

With the closure device 1 in the closed position in which the closure parts 2, 3 are positioned together, the structure elements 22, 32 of the closure parts 2, 3 are opposite one another in such a manner that the blocking faces 220, 320 of the structure elements 22, 32 face one another, as can be seen in FIGS. 3A to 3C. If the closure parts 2, 3 are loaded relative to one another along a load direction B1, B2 (by the first closure part 2 being pulled in the load direction B1 and the second closure part 3 being pulled in the load direction B2), the structure elements 22, 32 move into abutment with one another via the blocking faces 220, 320 thereof such that relative movement between the closure parts 2, 3 along the load direction B1, B2 is blocked. The closure device 1 can consequently be loaded in tension and is also capable of absorbing large forces without the closure parts 2, 3 being able to be detached from one another on account of the effect of the force.

The engagement between the structure elements 22, 32 is brought about and held, in this connection, on the one hand on account of the undercuts of the blocking faces 220, 320 and is additionally secured by means of the magnetic attraction between the arrangements of magnets 21, 31.

As can be seen in FIGS. 3A and 3D, the structure elements 22, 32 are separated from one another transversely to the load direction B1, B2 on each closure part 2, 3 by gaps being formed between the structure elements 22, 32. The structure elements 22, 32, which are V-shaped in form in a top view thereof, point with the tip of the V in the respectively assigned load direction B1, B2 (the structure elements 22 point with the tip of the V in the load direction B1, whilst the structure elements 32 point with the tip of the V in the load direction B2).

Figure 4A:
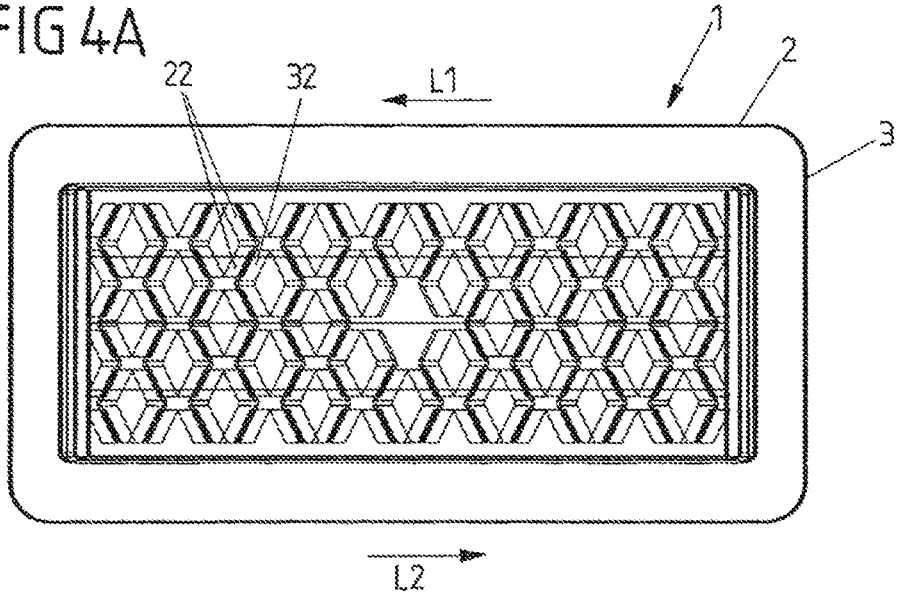
FIG. 4A shows a view through the arrangement according to FIG. 2, when opening the closure device.
Figure 4B:
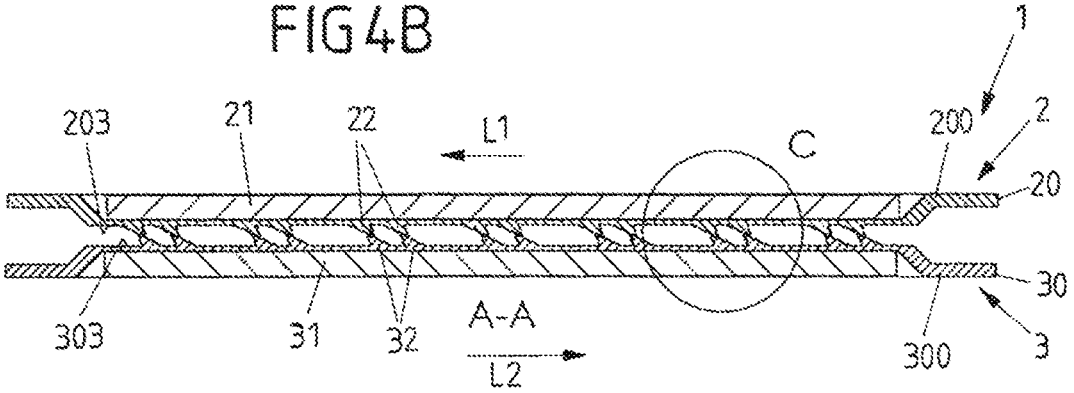
FIG. 4B shows a sectional view along the line A-A according to FIG. 2, when opening the closure device.
Figure 4C:
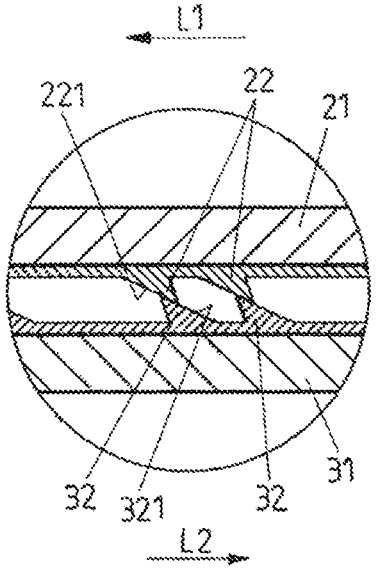
FIG. 4C shows an enlarged view of the detail C according to FIG. 4B.

For opening the closure device 1, the closure parts 2, 3 are moved away from one another. This can be effected by raising the one closure part 2, 3 from the other closure part 3, 2. However, opening can also be effected as a result of pulling the closure parts 2, 3 in opposition to the load direction B1, B2, namely in a release direction L1, L2, as is shown in FIGS. 4A to 4C.

By moving the closure parts 2, 3 in the release direction L1, L2 relative to one another, the structure elements 22, 32 run onto one another by way of the run-on surfaces 221, 321, and on account of the ramp form of the run-on surfaces 221, 321, the closure parts 2, 3 are lifted at least a little way apart from one another. As a result, the magnetic attraction between the arrangements of magnets 21, 31 of the closure parts 2, 3 is weakened such that the closure parts 2, 3 are able to be removed from one another in a simple manner.

The ramp form of the structure elements 22, 32 on the rear of the blocking faces 220, 320 additionally enables a type of mechanical freewheeling when the closure parts 2, 3 are pulled in opposition to the load direction B1, B2 (in the release direction L1, L2). Thus, a structure element 22 of the first closure part 2, when the first closure part 2 is pulled in the release direction L1, is removed with the blocking face 220 thereof from an assigned blocking face 320 of a structure element 32 of the second closure part 3 and slides with the run-on surface 221 thereof onto a run-on surface 321 of an adjacent structure element 32 of the second closure part 3 following in the release direction L1. Once the structure element 22 of the first closure part 2 has passed said adjacent structure element 32 of the second closure part 3, the blocking face 22 of said structure element 22 is then situated facing the blocking face 320 of the adjacent structure element 32 just passed such that the closure parts 2, 3 are offset to one another by precisely one structure element 22, 32 along the load direction B1, B2.

As a result of relative movement of the closure parts 2, 3 in the release direction L1, L2, the position of the closure parts 2, 3 can consequently be adapted in relation to one another as a result of tangential movement of the closure parts 2, 3. Ratchet-like sliding of the closure parts 2,3 in relation to one another is produced.

In the case of the exemplary embodiment according to FIGS. 1 to 4A-4C, the arrangements of magnets 21, 31 comprise magnetic poles N, S which are offset to one another transversely to the load direction B1, B2, as shown in FIG. 2. The arrangements of magnets 21, 31 are consequently periodic transversely to the load direction B1, B2. The periodicity of the magnetic poles N, S of the arrangements of magnets 21, 31, in this connection, is precisely in such a manner that when the closure parts 2, 3 are positioned together, the structure elements 22, 32 of the closure parts 2, 3 move into engagement with one another precisely in the correct position in order to block under load by means of the blocking faces 220, 320 thereof. Positioning the closure parts 2, 3 together in the correct position with reliable closing of the closure device 1 is consequently made easier on account of the multi-polarity of the arrangements of magnets 21, 31.

Figure 5:
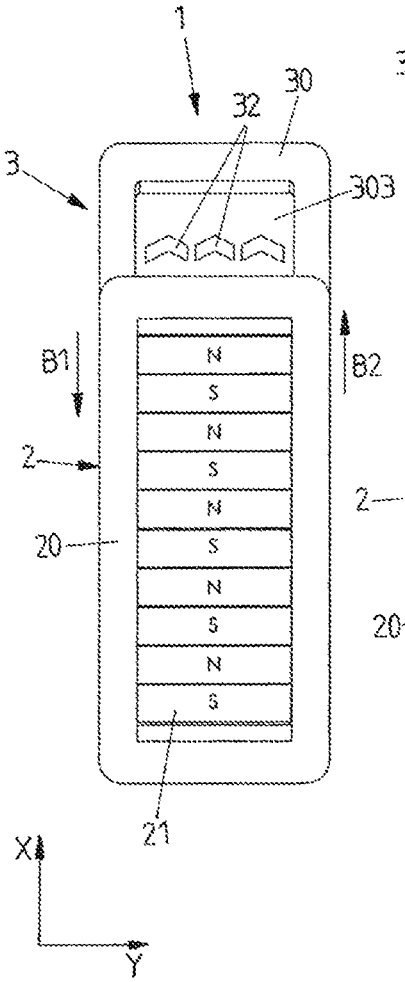
FIG. 5 shows a view of an exemplary embodiment of a closure device, with magnetic poles positioned together in rows along a load direction, on a closure part.
Figure 6:
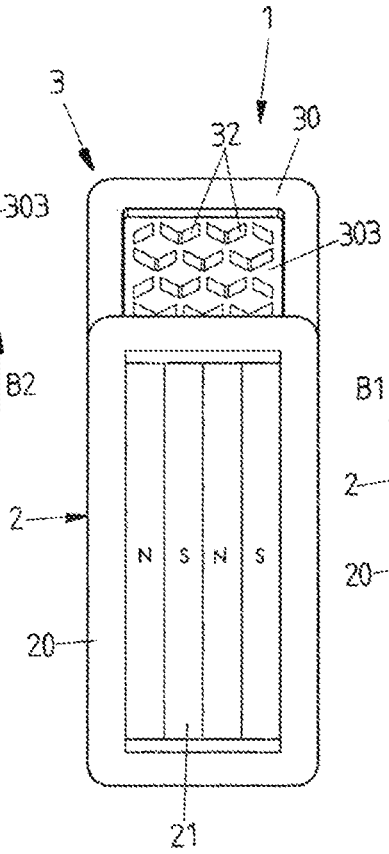
FIG. 6 shows a view of an exemplary embodiment of a closure device, with magnetic poles of a closure part positioned together in rows transversely to the load direction.
Figure 7:
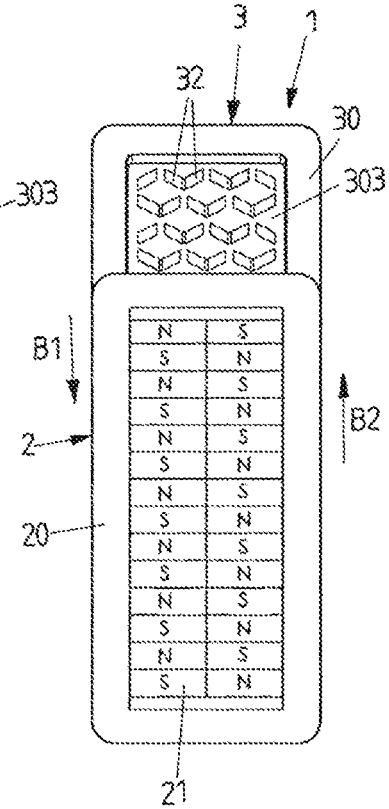
FIG. 7 shows a view of an exemplary embodiment with a two-dimensional grid of magnetic poles positioned together in rows along the load direction and transversely to the load direction.
Figure 8:
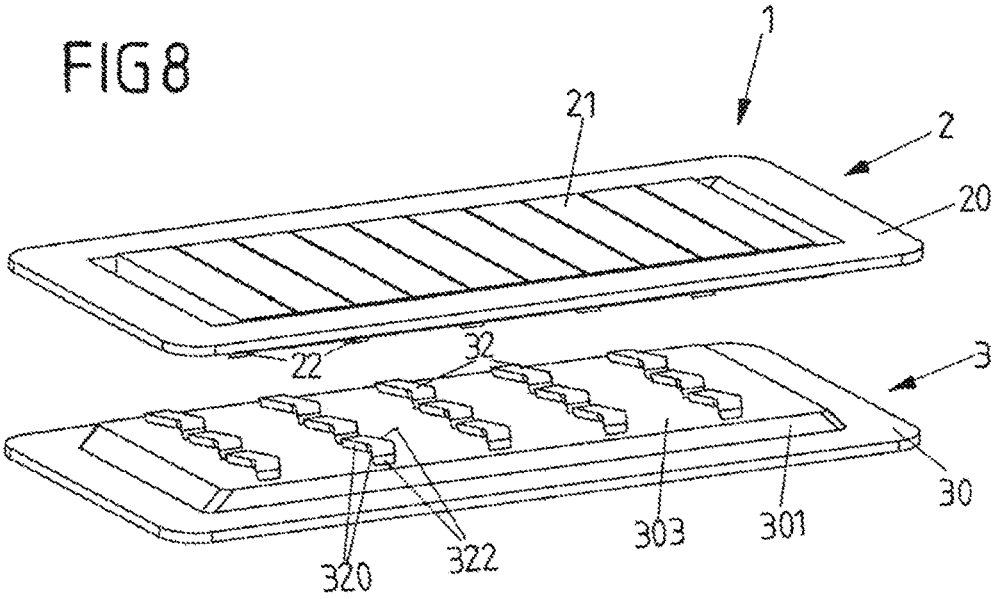
FIG. 8 shows a perspective view of a further exemplary embodiment of a closure device.
Figure 9:
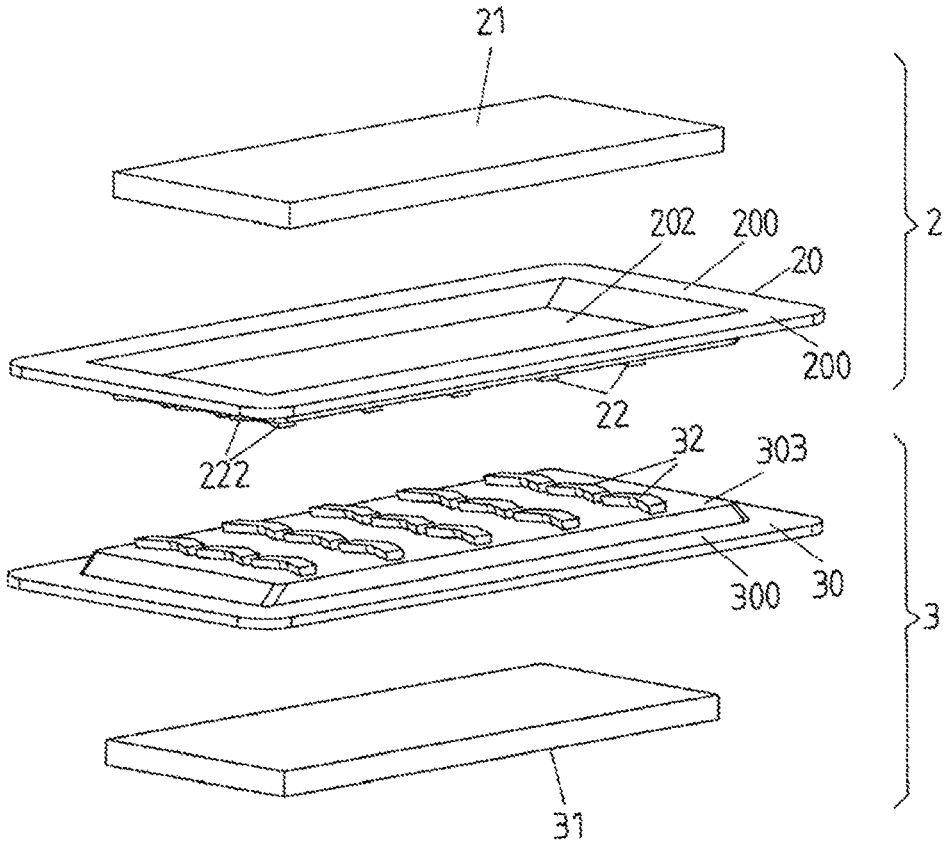
FIG. 9 shows an exploded representation of the arrangement according to FIG. 8.

Other pole configurations of the arrangement of magnets 21, 31 are conceivable and possible, as is shown in various exemplary embodiments in FIGS. 5 to 7.

FIG. 6, in this connection, corresponds functionally to the arrangement of the exemplary embodiment according to FIGS. 1 to 4A-4C.

In the case of the exemplary embodiment according to FIG. 5, the magnetic poles N, S of each arrangement of magnets 21, 31 are offset to one another along the load direction B1, B2 by the magnetic poles N, S being positioned together in rows alternating in a periodic manner along the load direction B1, B2.

In the case of the exemplary embodiment according to FIG. 7, in contrast each arrangement of magnets 21, 31 comprises a two-dimensional pattern of magnetic poles N, S, with a plurality of rows of magnetic poles along the load direction B1, B2 and two columns in the transverse direction Y transversely to the load direction B1, B2.

With the magnetic poles N, S offset to one another along the load direction B1, B2 in the case of the exemplary embodiments according to FIG. 5 and FIG. 7, the closure parts 2, 3 can be caused, in particular, to move into engagement with one another in the correct position along the load direction B1, B2. In particular, the arrangements of magnets 21, 31 can be arranged with respect to one another in such a manner that the structure elements 22 of the first closure part 2 and the structure elements 32 of the second closure part 3, when the closure parts 2, 3 are positioned, come to lie precisely between one another and not on top of one another (which could otherwise result in incomplete closing of the closure device 1).

Where the magnetic poles N, S of each arrangement of magnets 21, 31 are distributed in two-dimensions according to the exemplary embodiment according to FIG. 7, positioning in the correct position is made easier both along the load direction B1, B2 and transversely to the load direction B1, B2.

The arrangements of magnets 21, 31 can be formed by means of discrete permanent magnetic elements, for example by means of neodymium magnets. Each arrangement of magnets 21, 31 can be received in the indentation 202, 302 in the body 20, 30 of the assigned closure part 2, 3 and can be glued to or cast with the body 20, 30 of the closure part 2, 3. The indentation 202, 302 can be closed, in this case, toward the outside, for example by a cover, for example a film or the like.

As an alternative to this, each arrangement of magnets 21, 31 can be formed by a magnetic film, for example a plastics material film which, for example, includes a magnetic powder with a proportion of neodymium. Such a magnetic film can be received in the indentation 202, 302 of the respectively assigned closure part 2, 3 and glued to the body 20, 30 or connected in another manner. However, it is also conceivable and possible to produce the body 20, 30 of the closure parts 2, 3 entirely from such a magnetic film such that, in this case, the body 20, 30 and where applicable also the structure elements 22, 32 arranged thereon are magnetic.

FIGS. 8 to 12A-12D show another exemplary embodiment of a closure device 1 which differs from the exemplary embodiment described by way of FIGS. 1 to 4A-4C in particular by the shaping of the structure elements 22, 32.

In the case of the exemplary embodiment according to FIGS. 8 to 12A-12D, the structure elements 22, 32, which in top view are V-shaped analogous to the exemplary embodiment according to FIGS. 1 to 4A-4C, do not comprise any ramp-shaped run-on surfaces at the rear of blocking faces 220, 320 but are oriented perpendicularly to the surfaces 203, 303 on rear faces 223, 323 (remote from the blocking faces 220, 320).

Figure 10A:
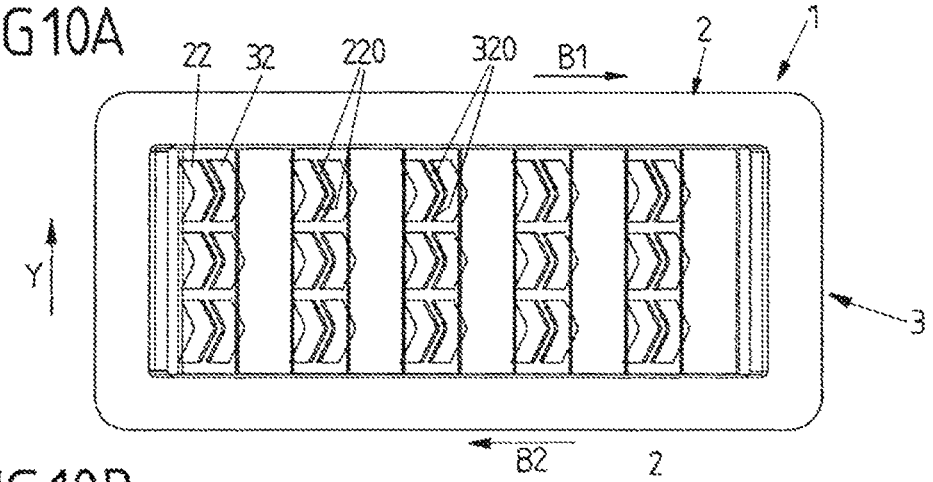
FIG. 10A shows a view through the closure device, in a closed position.
Figure 10B:
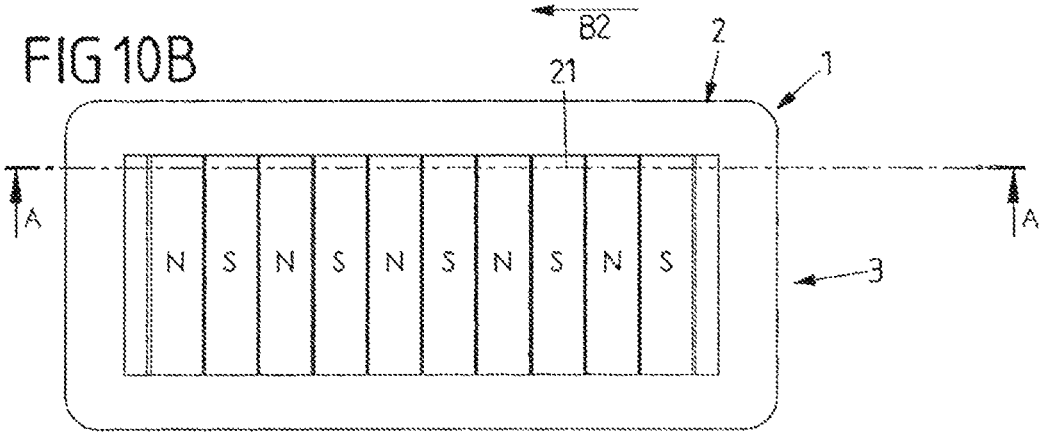
FIG. 10B shows a top view of the closure device.
Figure 10C:
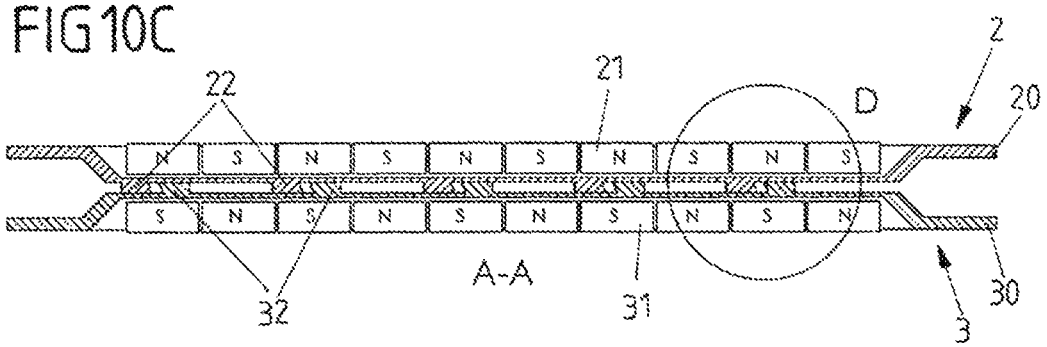
FIG. 10C shows a sectional view along the line A-A according to FIG. 10B.
Figure 10D:
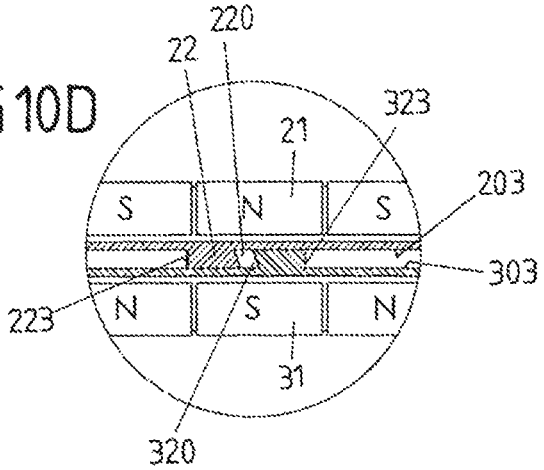
FIG. 10D shows an enlarged view of the detail D according to FIG. 10C.

In the closed position, shown in FIGS. 10A to 10D, the structure elements 22, 32 each engage in spaces between the structure elements 32, 22 on the respectively other part, each structure element 22 of the one first closure part 2 facing, by way of the blocking faces 220 thereof formed on the legs 222, 322, blocking faces 320 on the legs 322 of an assigned structure element 32 of the other second closure part 3, as can be seen in FIGS. 10C and 10D.

As can also be seen in FIGS. 10C and 10D, the arrangements of magnets 21, 31 of the closure parts 2, 3 face one another precisely with unlike magnetic poles N, S in the position shown such that the closure parts 2, 3 mutually attract one another and the structure elements 2, 3, as a result of positioning the closure parts 2, 3 together, move into the abutment shown in FIGS. 10A to 10D.

When the closure parts 2, 3 are loaded in the load direction B1, B2 relative to one another, the blocking faces 220, 320 of the structure elements 22, 32 move into abutment with one another, undercuts being formed on said blocking faces 220, 320 such that the engagement between the structure elements 22, 32 under load is not able to be easily released and is also consequently capable of absorbing large load forces.

The structure elements 22, 32 are dimensioned and arranged in relation to one another such that the closure parts 2, 3 are displaceable in relation to one another in the release direction L1, L2 by a release travel LW which corresponds to half the periodicity of the magnetic poles N, S of the arrangements of magnets 21, 31 without the structure elements 22, 32 adjoining one another in the release direction L1, L2.

Figure 11A:
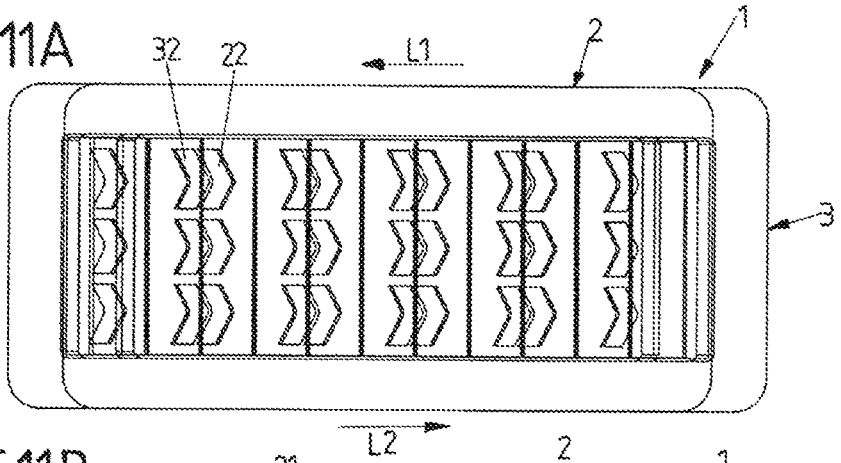
FIG. 11A shows a view through the closure device, when pulling in a release direction.
Figure 11B:
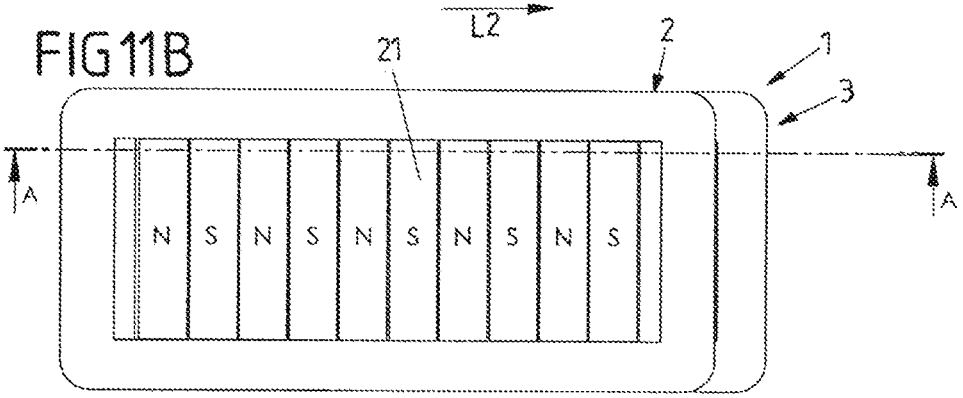
FIG. 11B shows a top view of the closure device.
Figure 11C:
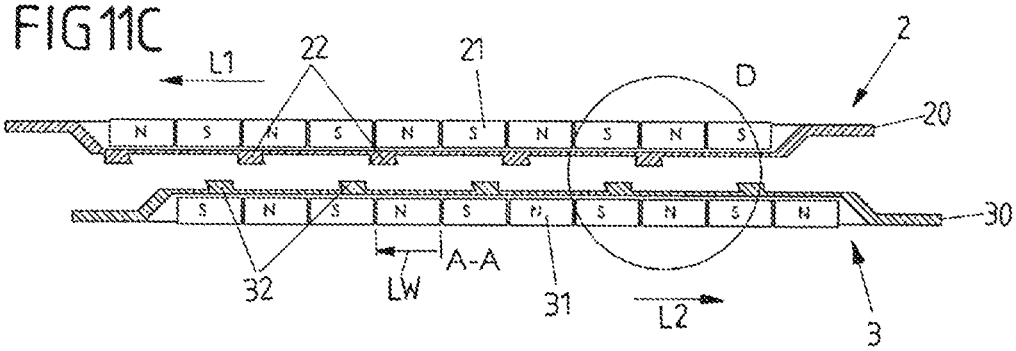
FIG. 11C shows a sectional view along the line A-A according to FIG. 11B.
Figure 11D:
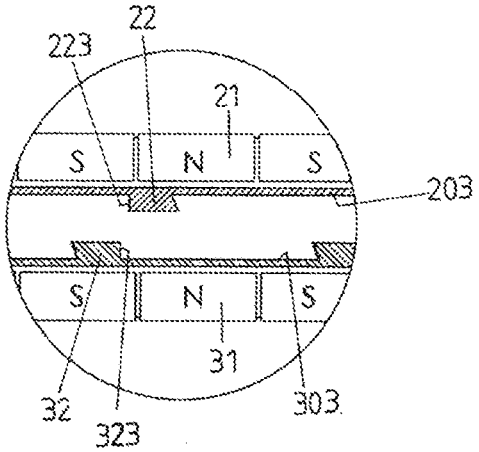
FIG. 11D shows an enlarged view of the detail D according to FIG. 11C.

If the closure parts 2, 3 are to be released from one another, the closure parts 2, 3 can be moved relative to one another in opposition to the load direction B1, B2, that is to say in a release direction L1, L2, by a release travel LW such that the structure elements 22, 32 move out of engagement with one another with the blocking faces 220, 320 thereof and additionally the arrangements of magnets 21, 31 are moved in relation to one another in such a manner that like poles N, S of the arrangement of magnets 21, 31 are moved closer together, as is shown in particular in FIGS. 11C and 11D. The closure parts 2, 3 consequently mutually repel one another such that the closure parts 2, 3 can easily be removed from one another.

By pulling the closure parts 2, 3 in the release direction L1, L2, it is also possible, however, in the manner of magnetic freewheeling—to adapt the position of the closure parts 2, 3 in opposition to the load direction B1, B2, that is to say in the release direction L1, L2. Thus, when the first closure part 2 is pulled in the release direction L1 (and resultant displacement by the release travel LW) on account of the magnetic repulsion between the closure parts 2, 3, the structure elements 22 of the one closure part 2 jump over the respectively following structure element 32 of the other second closure part 3, as is shown in FIGS. 11C and 11D.

Figure 12A:
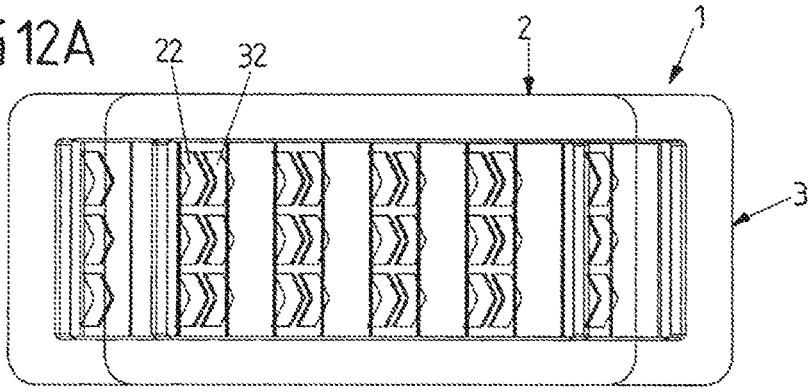
FIG. 12A shows a view through the closure device, in another closed position.
Figure 12B:
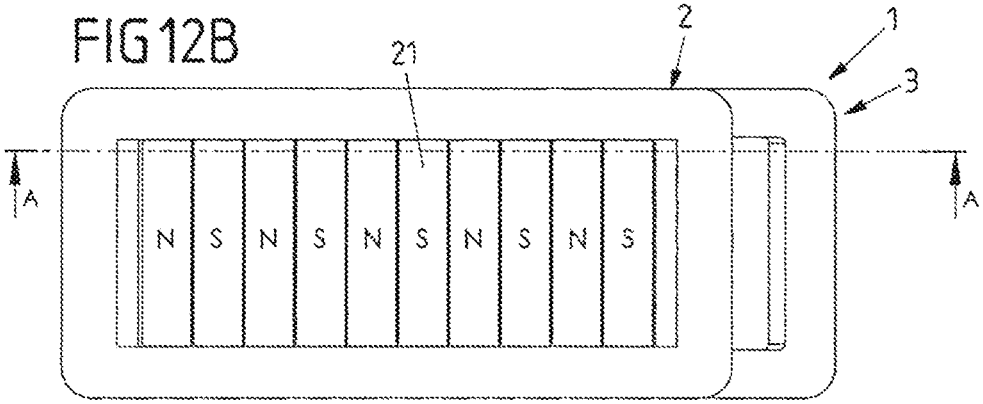
FIG. 12B shows a top view of the closure device.
Figure 12C:
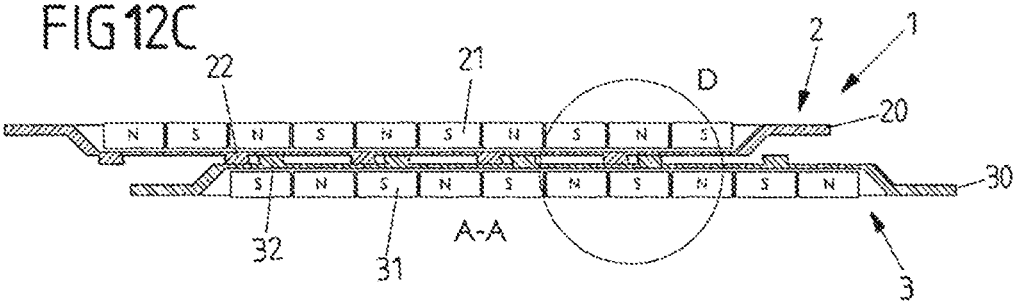
FIG. 12C shows a sectional view along the line A-A according to FIG. 12B.
Figure 12D:
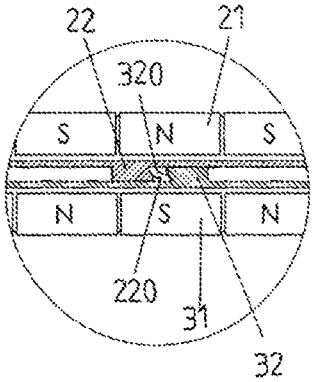
FIG. 12D shows an enlarged view of the detail D according to FIG. 12C.

When pulled further in the release direction L1, L2, the closure parts 2, 3 are pulled toward one another again when the arrangements of magnets 21, 31 once again move to face one another with unlike poles, as is shown in FIGS. 12C and 12D. Each structure element 22 of the first closure part 2 consequently once again, with the blocking faces 220 thereof, faces the blocking faces 320 of structure elements 32 on the other second closure part 3 such that the closure parts 2, 3 are offset to one another in the release direction L1, L2 precisely by the periodicity of the magnetic poles N, S of the arrangement of magnets 21, 31 (corresponding to the distance (of the periodicity) between adjacent rows of structure elements 21 31).

By the structure elements 22, 32 initially coming to rest at a distance from one another (viewed along the load direction, B1, B2) when the closure parts 2, 3 are positioned together (see FIGS. 10A to 10D), transverse displacement of the closure parts 2, 3 along the transverse direction Y is possible in the non-loaded state. This is not prevented because the blocking faces 220, 320 of the structure elements 22, 32 are not in abutment and engagement with one another. Such transverse displacement can enable simple opening of the closure device 1 by pushing the closure parts 2, 3 apart from one another.

Different arrangements and designs of structure elements 22, 32 on the closure parts 2, 3 are conceivable and possible.

Figure 13:
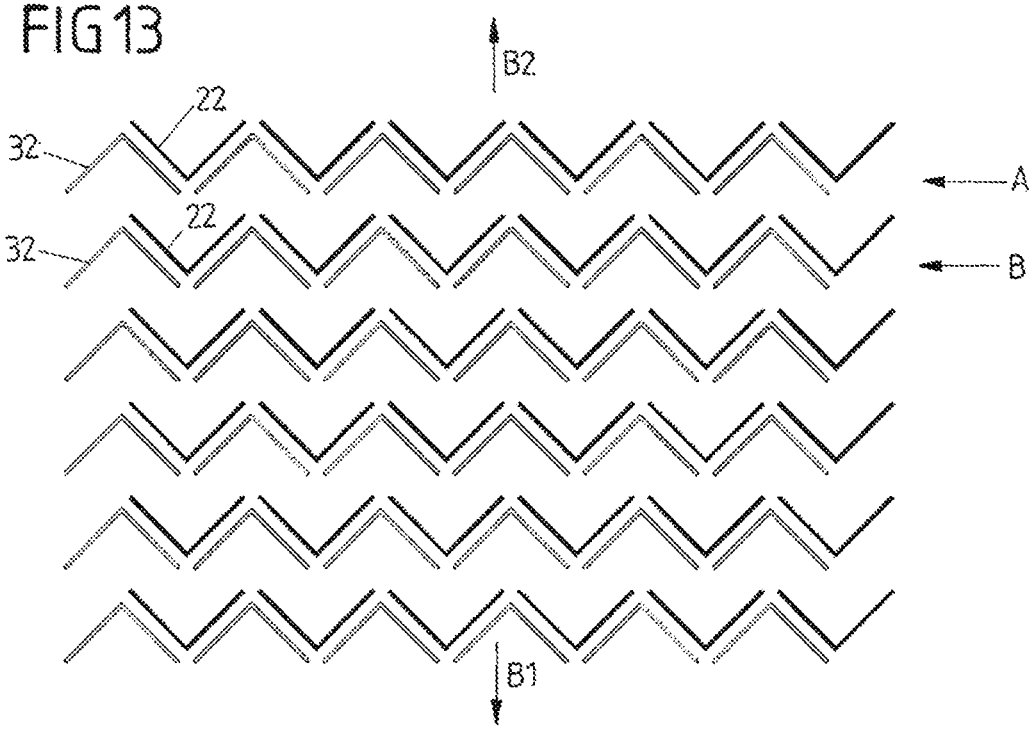
FIG. 13 shows a schematic view of an arrangement of structure elements.

In the case of the exemplary embodiment shown in FIG. 13, each closure part 2, 3 comprises structure elements 22, 32 which are aligned with respect to one another in a grid-shaped manner. Thus, multiple rows A, B each with a plurality of structure elements 22, 32 which, when the closure parts 2, 3 are positioned, interact structurally in such a manner that relative movement of the closure parts 2, 3 with respect to one another in the load direction B1, B2 is blocked, are provided on each closure part 2, 3.

In the case of the exemplary embodiment according to FIG. 13, the structure elements 22, 32 of the different rows A, B, when seen transversely to the load direction B1, B2, are not offset to one another. The structure elements 22, 32 of the different rows A, B of each closure part 2, 3 are consequently aligned with one another (when viewed along the load direction B1, B2).

Figure 14:
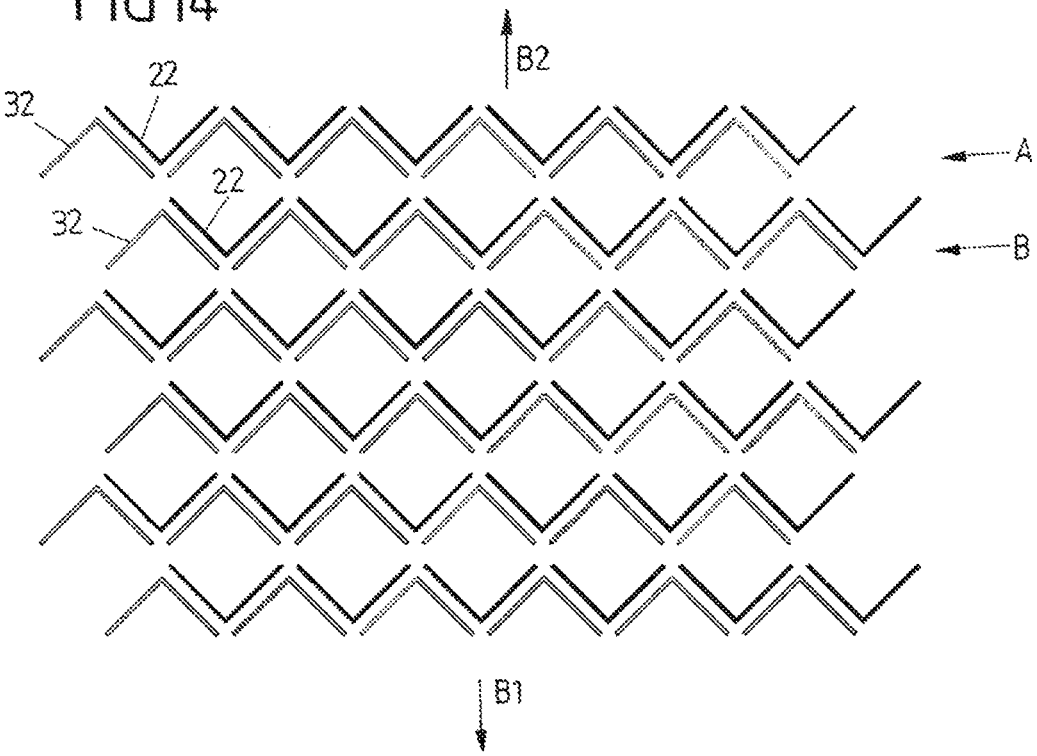
FIG. 14 shows a schematic view of another arrangement of structure elements.

In contrast, the structure elements 22, 32 of adjacent rows A, B in the case of the exemplary embodiment according to FIG. 14 are offset to one another precisely by half the width of a structure element 22, 32 (measured transversely to the load direction B1, B2). Once again, the structure elements 22, 32 of the two closure parts 2, 3 interact in a blocking manner when the closure parts 2, 3 are positioned together.

Figure 15:
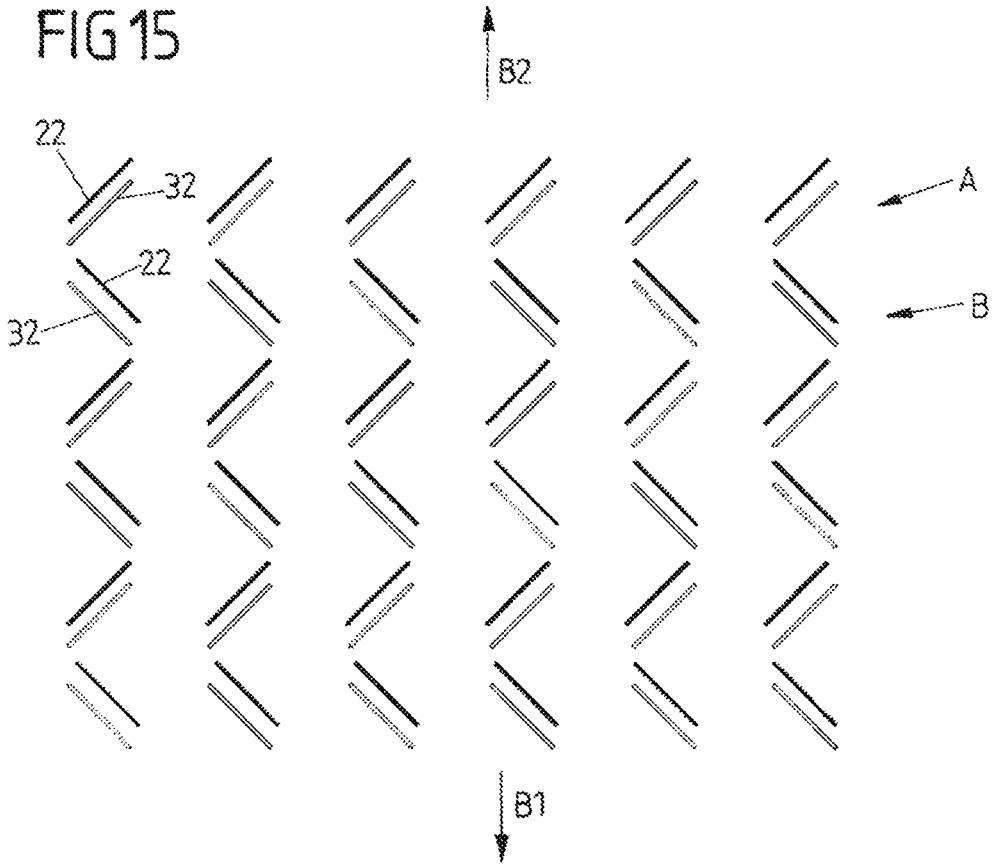
FIG. 15 shows a schematic view of yet another arrangement of structure elements.

In the case of the exemplary embodiment according to FIG. 15, the structure elements 22, 32 are each formed by a straight projection element which extends at an angle to the load direction B1, B2. The structure elements 22, 32 of adjacent rows A, B, in this connection, are arranged precisely in a mirror-inverted manner with respect to one another (the center line between the rows A, B corresponding to the mirror axis). Together the structure elements 22, 32 consequently block relative movement of the closure parts 2, 3 in the load direction B1, B2 and also transversely to the load direction B1, B2.

Figure 16:
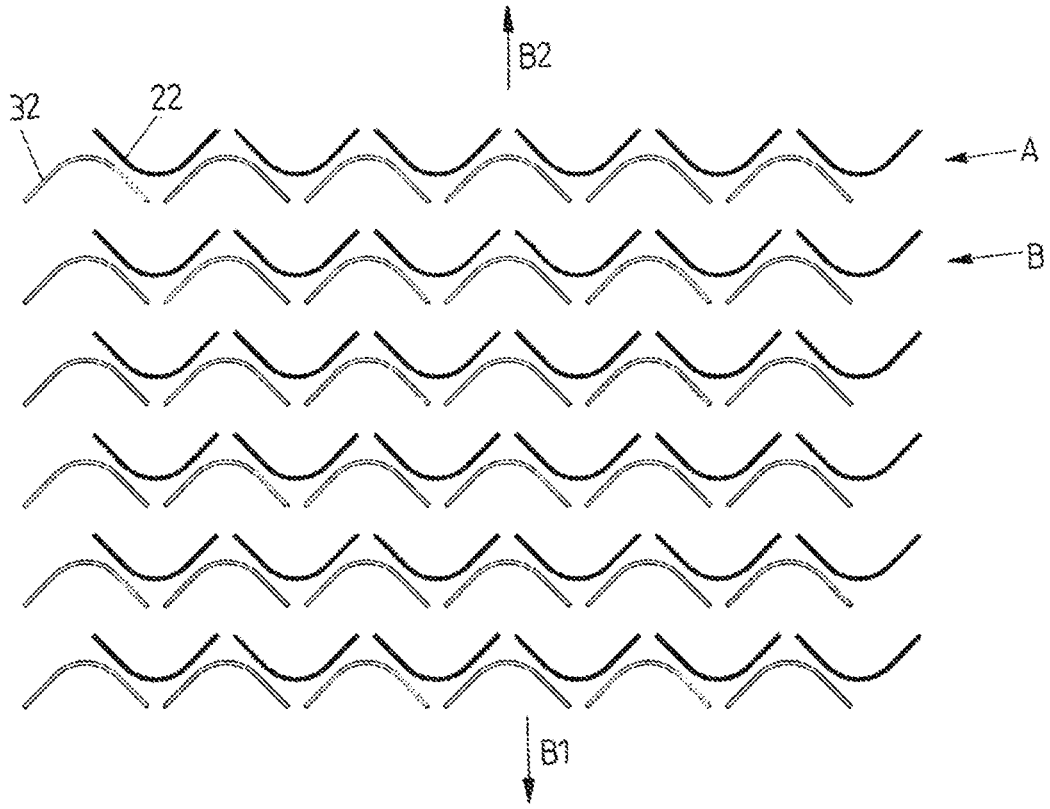
FIG. 16 shows a view of yet another arrangement of structure elements.

In the case of the exemplary embodiment according to FIG. 16, the basic form of the structure elements 22, 32 is V-shaped, but, in this case, curved at the tips thereof. In the closed position, the structure elements 22 of the first closure part 2 come to rest precisely between the structure elements 32 of the other second closure part 3 (viewed in the transverse direction Y transversely to the load direction B1, B2).

Figure 17:
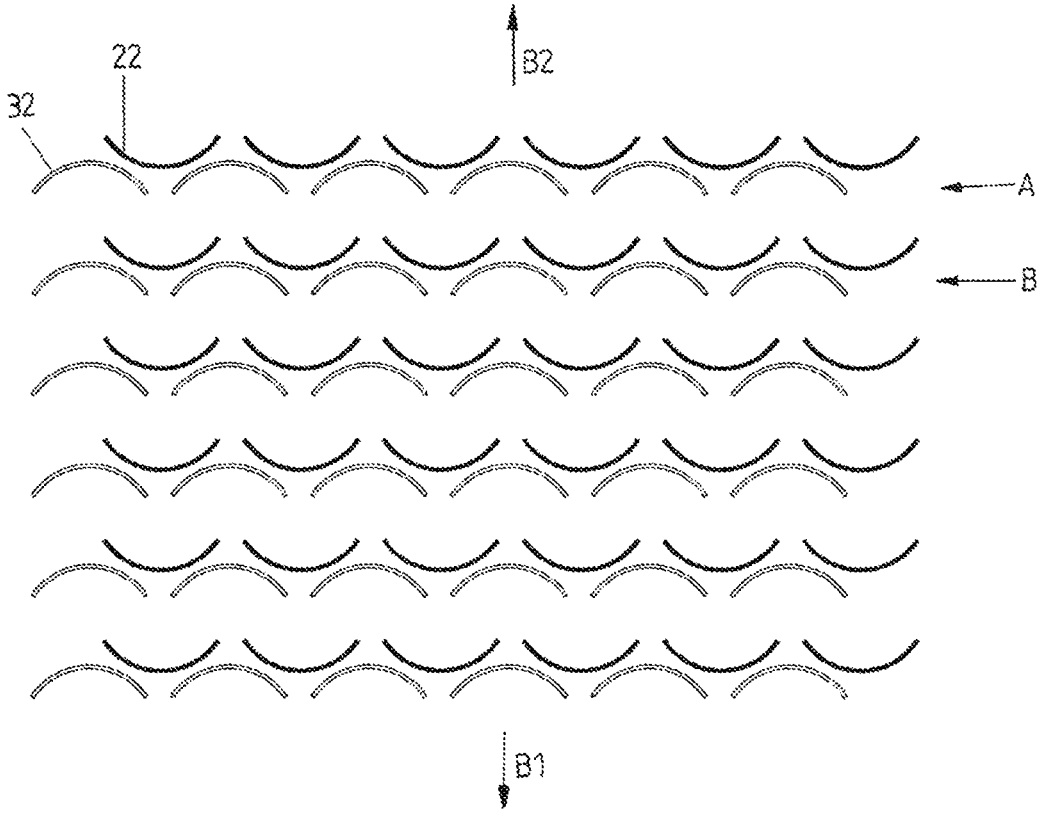
FIG. 17 shows a view of yet another arrangement of structure elements.

In the case of the exemplary embodiment according to FIG. 17, the structure elements 22, 32 are realized in an arcuate manner.

Figure 18A:
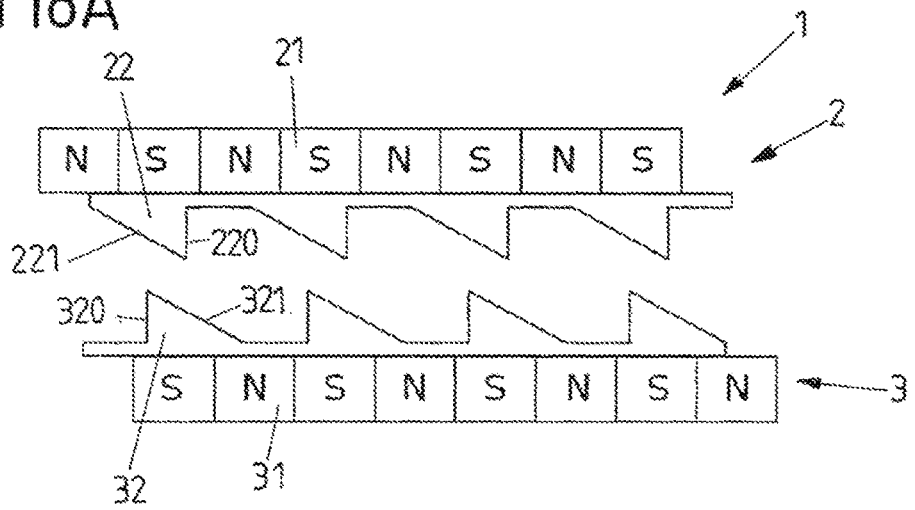
FIG. 18A shows a schematic view of an exemplary embodiment of a closure device, in the open position.
Figure 18B:
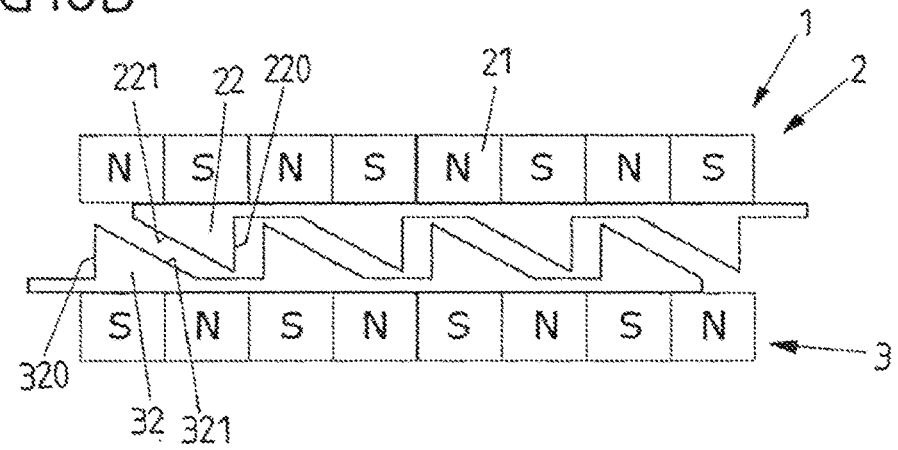
FIG. 18B shows the closure device when closing.
Figure 18C:
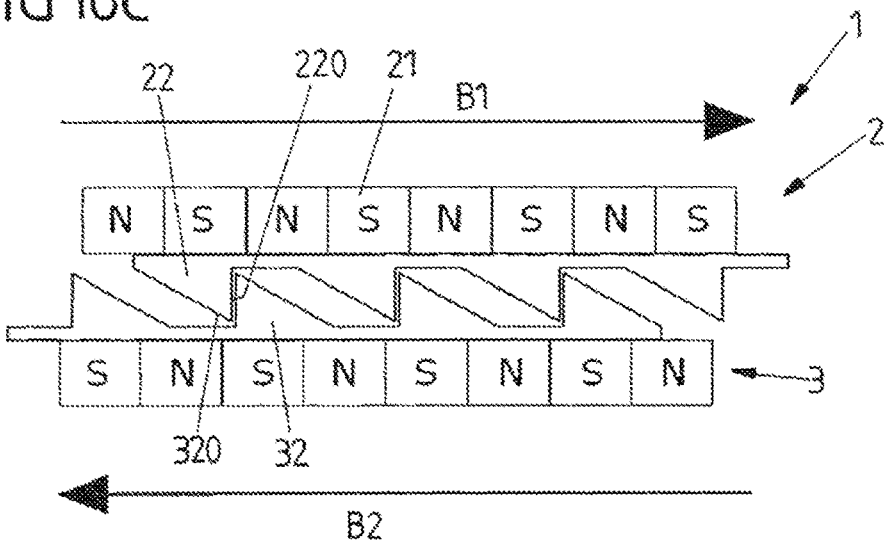
FIG. 18C shows the closure device in the loaded state.

If the magnetic poles N, S of the arrangements of magnets 21, 31 are positioned in rows together in an alternating manner along the load direction B1, B2, the arrangements of magnets 21, 31 can be aligned with respect to one another precisely in such a manner as is shown by way of an exemplary embodiment in FIGS. 18A to 18C. Here, when the magnetic poles N, S are situated facing one another for positioning of the closure parts 2, 3, the blocking faces 220, 320 of the structure elements 22, 32 of the two closure parts 2, 3 are spaced apart from one another. When the closure parts 2, 3 are positioned together, the blocking faces 220, 320 consequently do not move directly into abutment with one another but the structure elements 22, 32 (initially) come to rest between one another. This can make the positioning of the closure parts 2, 3 together easier because tilting the structure elements 22, 32, in particular the structure elements 22, 32 lying one on top of another, is avoided. The blocking faces 220, 320 do not move into abutment with one another until loaded in the load direction B1, B2, as shown in FIG. 18C, such that relative movement between the closure parts 2, 3 is blocked.

Figure 19A:
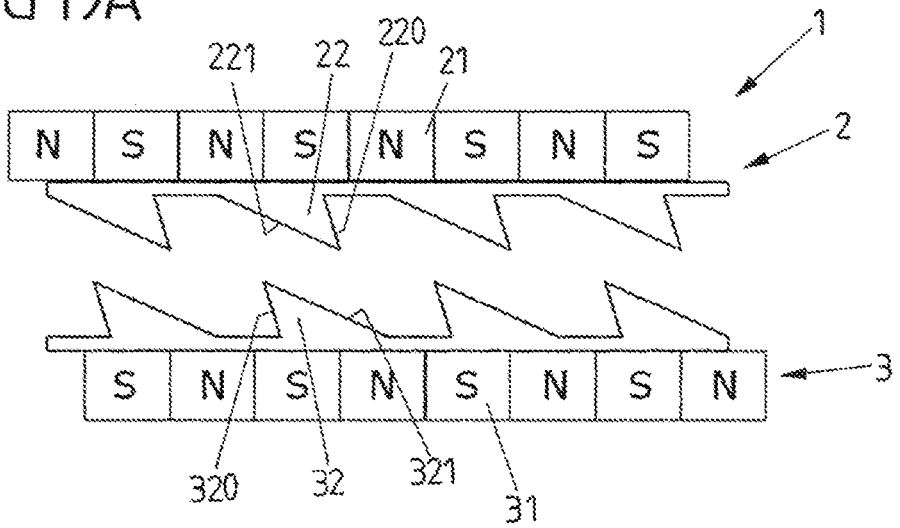
FIG. 19A shows a schematic view of yet another exemplary embodiment of a closure device, in the open position.
Figure 19B:
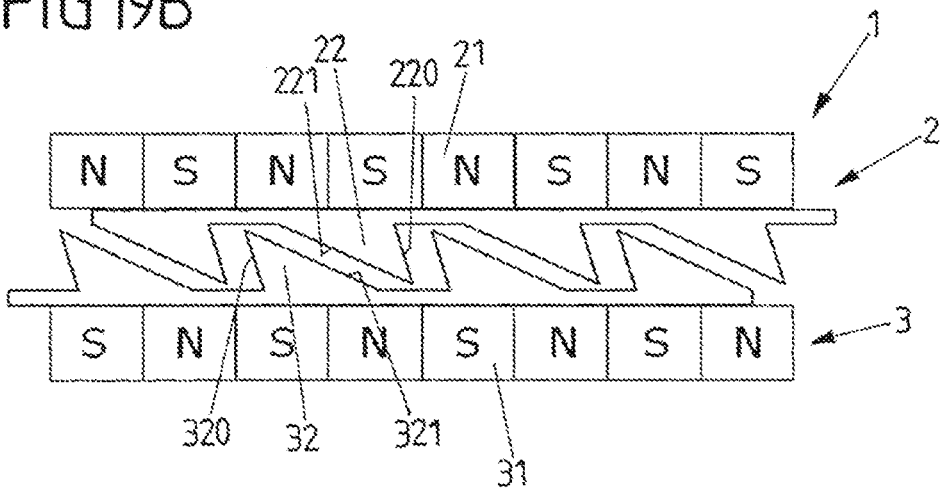
FIG. 19B shows the closure device when closing.
Figure 19C:
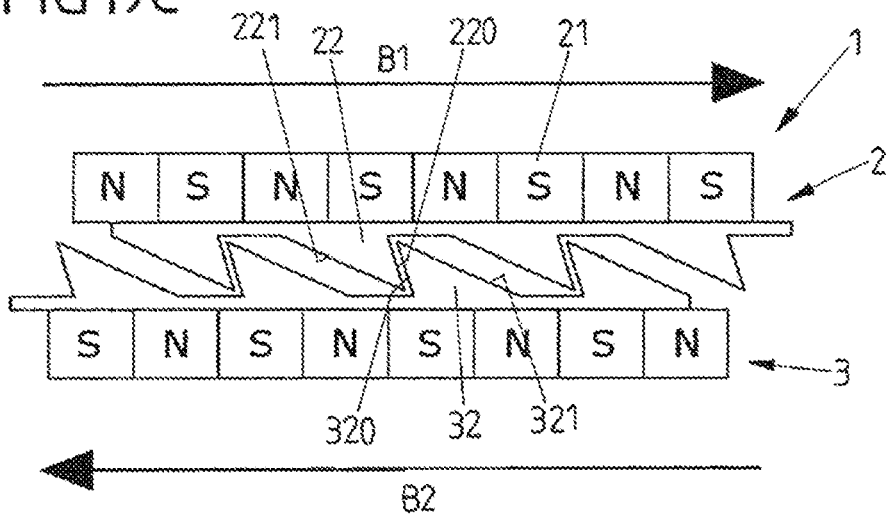
FIG. 19C shows the closure device in the loaded state.

This is shown analogously in FIGS. 19A to 19C for an exemplary embodiment where the structure elements 22, 32 comprise undercuts on the blocking faces 220, 320 thereof. In particular in this case, the positioning of the closure parts 2, 3 can be made easier by the magnetic poles N, S of the arrangement of magnets 21, 31 facing one another and the blocking faces 220, 320 of the structure elements 22, 32 being spaced apart from one another.

FIGS. 20 to 26 show various exemplary embodiments of arrangements of magnets 21, 31 with magnetic poles N, S of various periodicity P2 (along the load direction B1, B2) and with various designs of the magnetic poles N, S.

Figure 20:
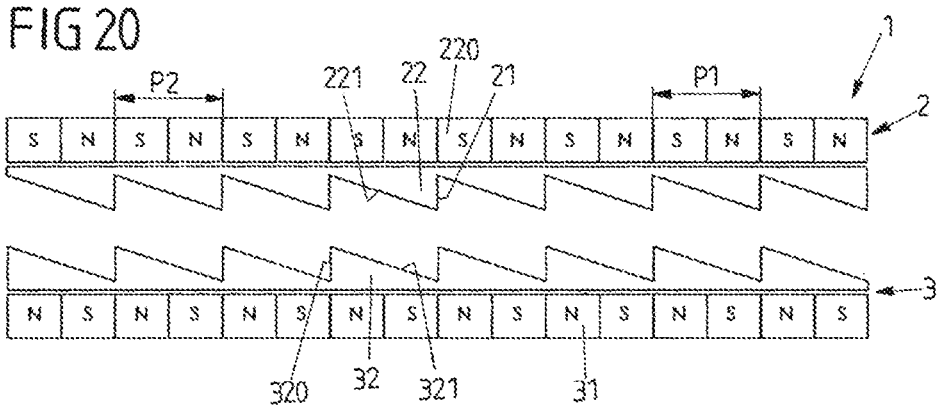
FIG. 20 shows another schematic view of an exemplary embodiment of a closure device.

Thus, in the case of the exemplary embodiment according to FIG. 20, the periodicity P2 of the arrangement of magnets 21, 31 corresponds precisely to the periodicity P1 of the structure elements 22, 32.

Figure 21:
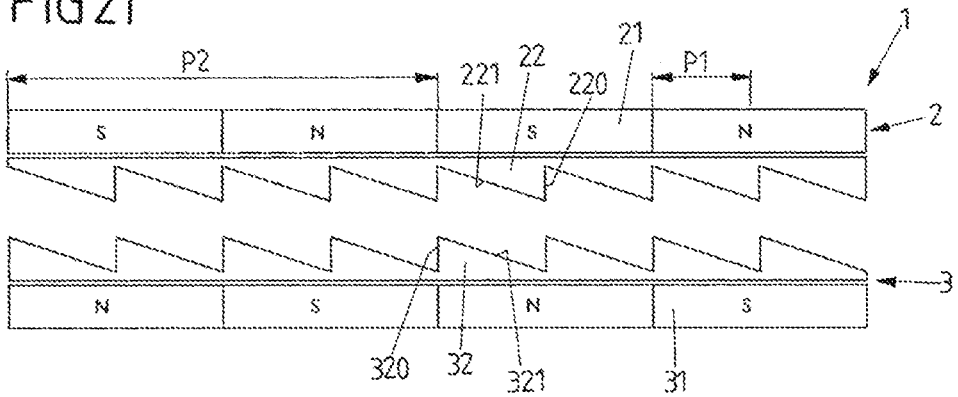
FIG. 21 shows a view of an exemplary embodiment of a closure device, with greater periodicity of the arrangements of magnets.

In the case of the exemplary embodiment according to FIG. 21, the periodicity P2 of the arrangement of magnets 21, 31 corresponds, in contrast, to four times the periodicity P1 of the structure elements 22, 32. In the case of the exemplary embodiment according to FIG. 21, the number of positions in which the closure parts 2, 3 can be positioned together so as to be magnetically attracting is consequently reduced.

Figures 22, 23, 24, 25, 26:
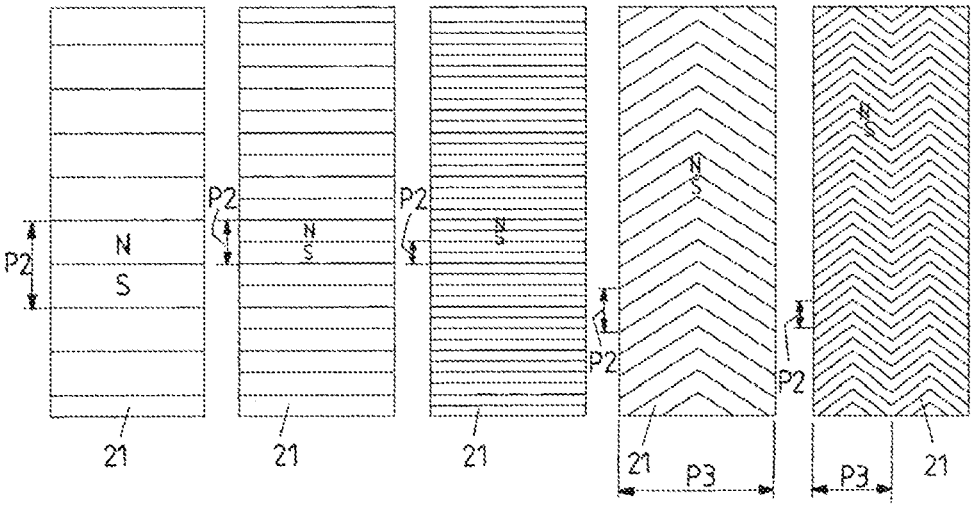
FIGS. 22-26 show representations of different arrangements of magnets on a closure part.

FIGS. 22 to 24 show arrangements of magnets 21 with various periodicity P2 along the load direction B1, B2. In the case of the exemplary embodiment according to FIG. 23, the periodicity P2 is halved in relation to the periodicity P2 of the exemplary embodiment according to FIG. 22, and in the case of the exemplary embodiment according to FIG. 24, the periodicity P2 of the magnetic poles N, S of the arrangement of magnets 21 is halved in relation to the periodicity P2 of the arrangement of magnets 21 in the case of the exemplary embodiment according to FIG. 23.

FIGS. 25 and 26 illustrate that the magnetic poles N, S do not necessarily have to extend in a straight line along the transverse direction (or where applicable also along the load direction B1, B2) but can also comprise, for example, a V form. In this connection, it is also possible, as shown in FIG.

26, to design the magnetic poles N, S in a zigzag-shaped manner, with a periodicity P3 along the transverse direction Y.

The closure device 1 with the closure parts 2, 3 thereof can be flexible at least to a certain degree in order, for example, to be used on a garment or on a receptacle. In this connection, however, it must be ensured that torsion on the structure elements 22, 32 does not result, once the structure elements 2, 3 have been positioned together, in the structure elements 22, 32 moving out of engagement with one another and consequently the connection between the closure parts 2, 3 being released.

For this purpose, the extension of the structure elements 22, 32 at an angle to the load direction B1, B2 can be advantageous, as is to be explained below by way of FIGS. 29 to 34.

Figure 29:
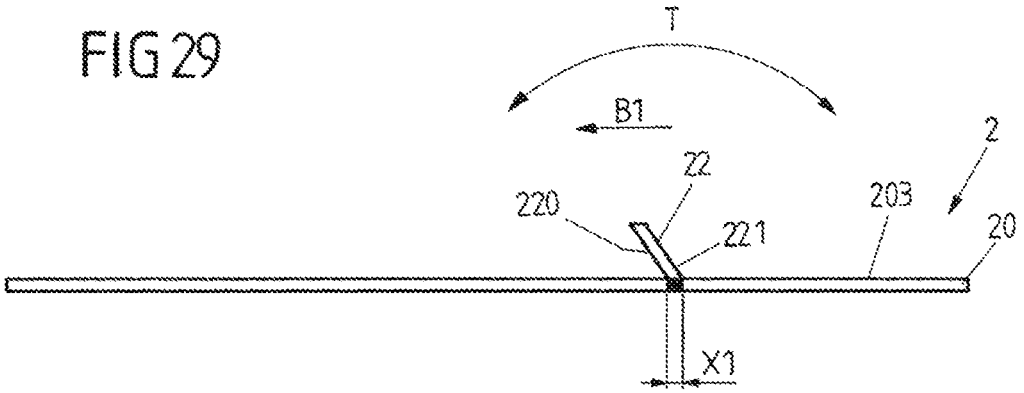
FIG. 29 shows a side view of the arrangement according to FIG. 27.
Figure 27:
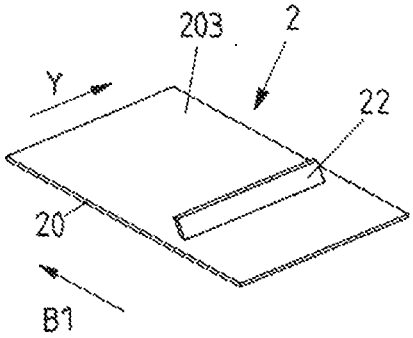
FIG. 27 shows a perspective view of a closure part, with a structure element arranged thereon extending in a straight manner.
Figure 31A:
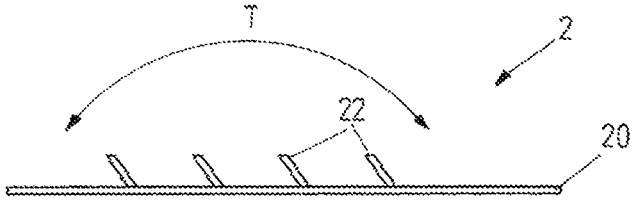
FIG. 31A shows a side view of another arrangement of structure elements of a closure part, extending in a straight manner.
Figure 31B:
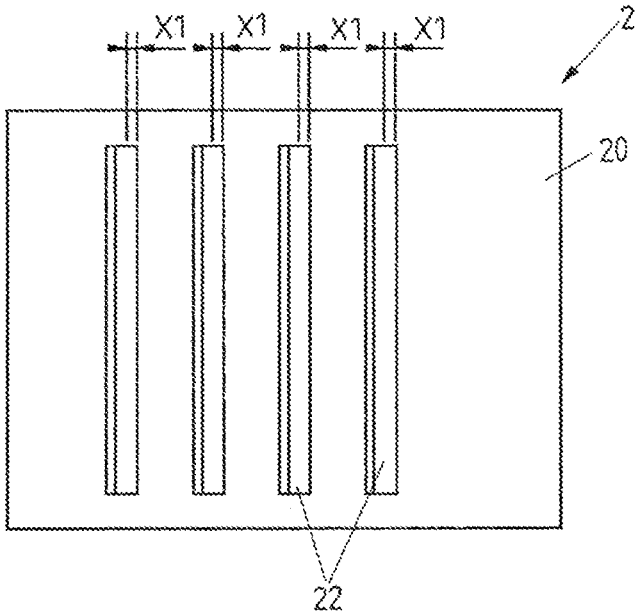
FIG. 31B shows a top view of the arrangement according to FIG. 31A.

In the case of a structure element 22 which extends in a straight line and is aligned transversely to the load direction B1, B2, as is shown as an example in FIG. 27 and FIG. 29, as well as in the case of an arrangement of multiple structure elements 22 which extend in a straight line and are aligned transversely, as shown as an example in FIGS. 31A and 31B, the length X1, along which the structure element 22 acts in opposition to a torsion T in a reinforcing manner about the transverse direction Y (in the direction of a curvature along the load direction B1, B2), corresponds precisely to the edge width by means of which the structure element 22 is fastened to the body 20 of the assigned closure part 2.

One single structure element 22 (see for example FIGS. 27 and 29) and also one arrangement of structure elements 22 (see FIGS. 31A and 31B) can consequently hardly oppose a torsion T which acts about the transverse direction Y and results in a curvature along the load direction B1, B2.

Figure 30:
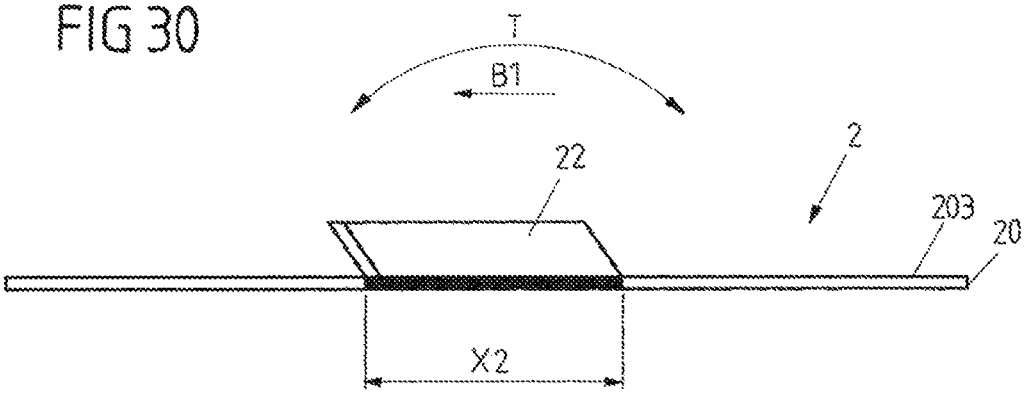
FIG. 30 shows a side view of the arrangement according to FIG. 28.
Figure 28:
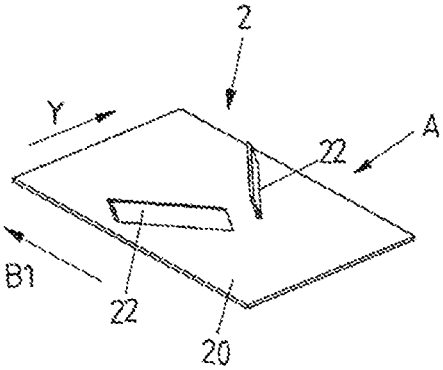
FIG. 28 shows a perspective view of a closure part, with structure elements extending at an angle.
Figure 32A:
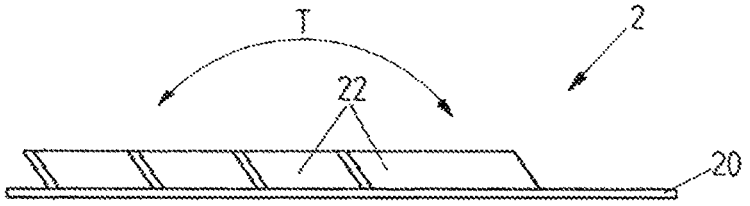
FIG. 32A shows a side view of another arrangement of structure elements of a closure part, extending at an angle.
Figure 32B:
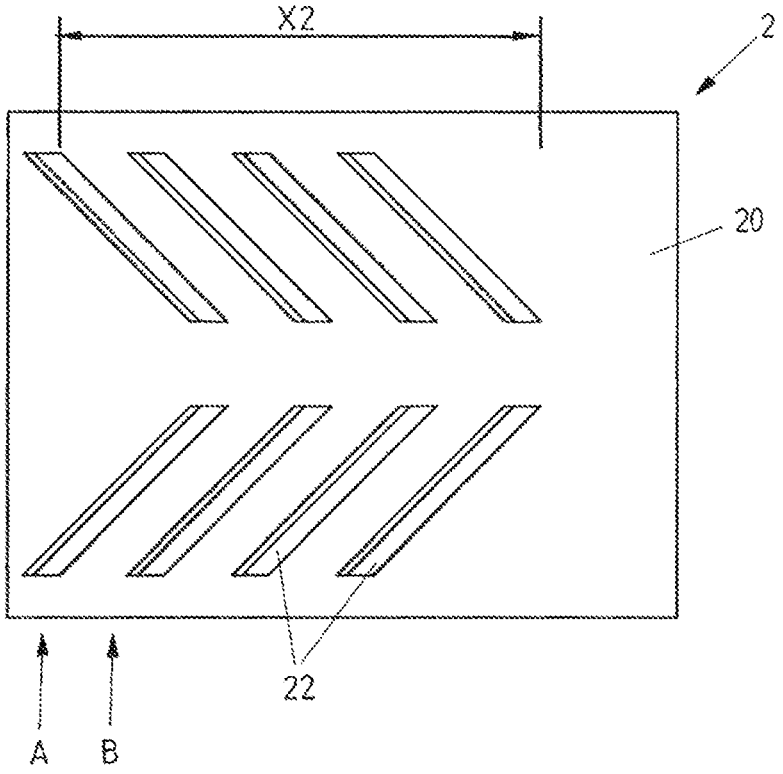
FIG. 32B shows a top view of the arrangement according to FIG. 32A.

This is different in the case of structure elements 22 which extend at an angle, as shown as an example in FIGS. 28 and 30 for a row A of structure elements 22 and in FIGS. 32A, 32B for multiple rows A, B of structure elements 22 positioned in rows together. For a structure element 22 which extends at an angle, the length X2, by means of which the structure element 22 acts in a reinforcing manner about the transverse direction Y in opposition to a torsion T, corresponds to the length projected into the load direction B1, B2, as can be seen in FIG. 30 and FIGS. 32A and 32B. The structure elements 22 consequently act effectively in opposition to a torsion T about the transverse direction Y and a curvature of the closure part 2 along the load direction B1, B2.

Figure 33:
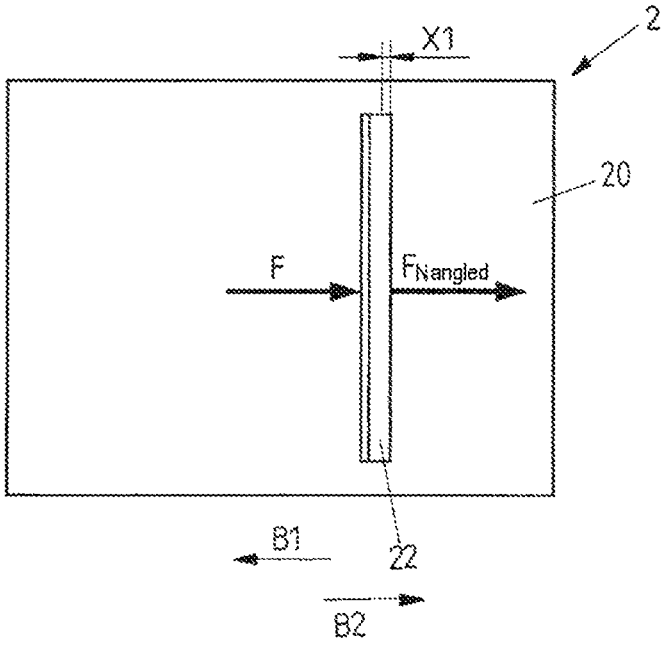
FIG. 33 shows a top view of a closure part with a structure element extending in a straight line.
Figure 34:
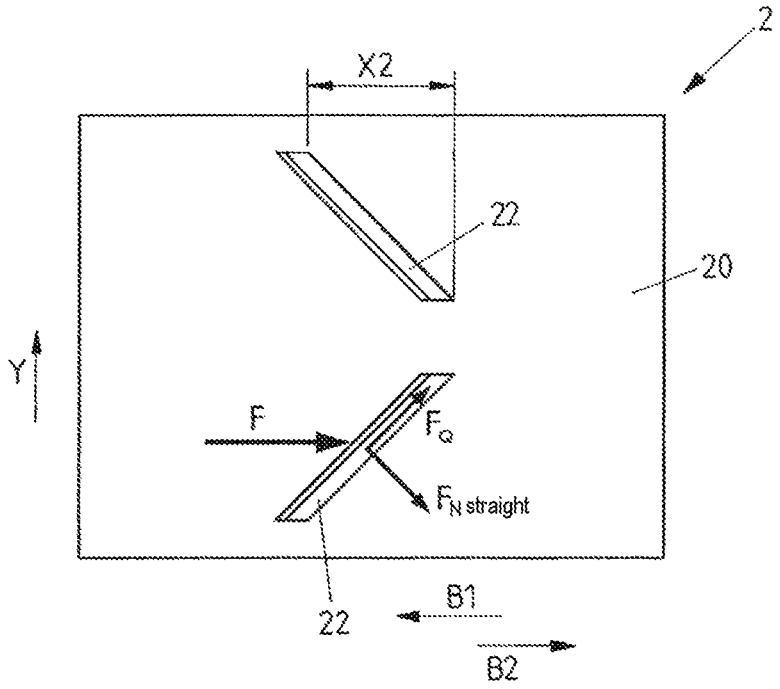
FIG. 34 shows a top view of a closure part with structure element extending at an angle.

The structure elements 22 which extend at an angle additionally act for self-reinforcement of the connection between the closure parts 2, 3, as can be seen in FIGS. 33 and 34.

Thus, in the case of a structure element 22 which extends in a straight line and is aligned transversely to the load direction B1, B2 as shown in FIG. 33, transverse displacement along the transverse direction Y is not prevented such that the closure parts 2, 3 are able to be displaced transversely to one another even in the loaded state and consequently opening of the closure device 1 in the loaded state, where applicable also unintended opening, is possible.

In the case of structure elements 22 which extend at an angle, as shown in FIG. 34, a force F is however transferred at the structure elements 22 into a normal force FN and a tangential force FQ, the tangential force FQ acting in the direction of the structure element 22 respectively adjacent along the transverse direction Y and consequently being supported by said adjacent structure element 22. Thus, in the case of the structure element 22 shown at the bottom in FIG. 34, the tangential force FQ acts obliquely upward and is supported by the structure element 22 arranged above the structure element 22 such that the engagement of the arrangement of structure elements 22 of the closure part 2 in the assigned structure elements 32 of the other closure part 3 is self-reinforcing and transverse displacement, in particular, along the transverse direction Y is impeded.

The concept underlying the solution is not restricted to the exemplary embodiments depicted above but can also be realized in principle in a completely different manner.

Thus, entirely different structure forms of the structure elements on the surfaces of the closure parts are conceivable and possible. For example, a roughening with (microscopically) small structure elements, which can protrude regularly or irregularly from the surface and consequently realize mountains and valleys which are arranged with respect to one another in a regular or irregular manner, can be provided on the surfaces.

The closure parts can comprise an arrangement of magnets produced from discrete permanent magnetic elements, for example neodymium magnets.

However, it is also conceivable and possible for the closure parts to comprise one or multiple magnetic films which are glued or welded to the bodies of the closure parts. It is also conceivable and possible in this connection for the bodies of the closure parts themselves to be realized by a permanent-magnetic (film) material, for example by incorporating a magnetic powder.

LIST OF REFERENCES

1 Closure device
2, 3 Closure part
20, 30 Body
200, 300 Edge
201, 301 Raised portion
202, 302 Indentation
203, 303 Surface
21, 31 Arrangement of magnets
22, 32 Structure element
220, 320 Blocking face (undercut)
221, 321 Run-on surface (ramp)
222, 322 Leg
223, 323 Rear surface
A, B Row
B1, B2 Load direction
F Force
L1, L2 Release direction
N, S Magnetic pole
P1-P3 Periodicity
X1, X2 Length
X Longitudinal direction
Y Transverse direction

The invention claimed is:

1. A closure device for connecting two parts, comprising
a first closure part which comprises a first surface with an arrangement of first structure elements arranged thereon and
a second closure part which comprises a second surface with an arrangement of second structure elements arranged thereon, wherein the first closure part and the second closure part are to be positioned together in such a manner that the first surface of the first closure part faces the second surface of the second closure part such that the first structure elements and the second structure elements engage in one another in such a manner that movement of the closure parts relative to one another along a load direction is blocked, wherein the first closure part comprises a first arrangement of magnets with a plurality of magnetic poles which are offset to one another along the first surface and the second closure part comprises a second arrangement of magnets with a plurality of magnetic poles which are offset to one another along the second surface, wherein at least one of the first structure elements and the second structure elements, in a top view of the respective surface, each comprise a curved form or a V-form, wherein at least one of the first closure part comprises a plurality of rows of first structure elements arranged on the first surface, the rows of first structure elements being offset to one another along the load direction and each comprising multiple first structure elements having a curved form or a V-form, and the second closure part comprises a plurality of rows of second structure elements arranged on the second surface, the rows of second structure elements being offset to one another along the load direction and each comprising multiple second structure elements having a curved form or a V-form.

2. The closure device as claimed in claim 1, wherein the first structure elements and the second structure elements are realized in an identical manner.

3. The closure device as claimed in claim 1, wherein the first structure elements protrude from the first surface and the second structure elements protrude from the second surface.

4. The closure device as claimed in claim 1, wherein the first structure elements comprise first blocking faces and the second structure elements comprise second blocking faces, wherein the first structure elements and the second structure elements move to abut against one another in a blocking manner by way of the blocking faces thereof when the closure parts are loaded in the load direction.

5. The closure device as claimed in claim 4, wherein at least one of the first blocking faces of the first structure elements are oriented perpendicularly to the first surface and the second blocking faces of the second structure elements are oriented perpendicularly to the second surface or at least one of the first blocking faces of the first structure elements are oriented at an angle for realizing an undercut with respect to the first surface and the second blocking faces of the second structure elements are oriented at an angle for realizing an undercut with respect to the second surface.

6. The closure device as claimed in claim 4, wherein the first structure elements comprise first run-on surfaces and the second structure elements comprise second run-on surfaces, wherein the first structure elements and the second structure elements run onto one another by way of the run-on surfaces thereof when the closure parts are loaded in opposition to the load direction.

7. The closure device as claimed in claim 1, wherein the first run-on surfaces and the second run-on surfaces realize ramps which extend at an angle to the surface of the assigned closure part.

8. The closure device as claimed in claim 1, wherein at least one of the first structure elements and the second structure elements comprise at least one leg each which extends along the assigned surface and is aligned at a slanted angle to the load direction.

9. The closure device as claimed in claim 1, wherein at least one of the first structure elements and the second structure elements comprise two legs each which are aligned at an angle, in particular an obtuse angle, to one another.

10. The closure device as claimed in claim 9, wherein the structure elements of adjacent rows, when viewed transversely to the load direction, are not offset to one another or are offset to one another by half the width of a structure element, measured transversely to the load direction and along the assigned surface of the assigned closure part.

11. The closure device as claimed in claim 1, wherein at least one of the first arrangement of magnets and the second arrangement of magnets is formed at least in portions by an arrangement of permanent magnetic elements or by a multipole permanent magnetic film.

12. The closure device as claimed in claim 1, wherein at least one of the magnetic poles of the first arrangement of magnets and the magnetic poles of the second arrangement of magnets are positioned together in rows periodically.

13. The closure device as claimed in claim 12, wherein at least one of:

at least one of the first structure elements and the second structure elements comprise a first periodicity and at least one of the magnetic poles of the first arrangement of magnets and the magnetic poles of the second arrangement of magnets comprise a second periodicity, wherein the first periodicity corresponds to the second periodicity or to a whole number multiple of the second periodicity, and at least one of the first structure elements and the second structure elements are arranged in such a manner on the closure parts that the closure parts are displaceable relative to one another by a release travel in opposition to the load direction, and in the case of displacement by the release travel, like magnetic poles of the arrangements of magnets move to face one another in a magnetically repelling manner.

14. The closure device as claimed in claim 12, wherein the first arrangement of magnets and the second arrangement of magnets are arranged in such a manner with respect to the respectively assigned structure elements that once the closure parts have been positioned together, the closure parts are displaceable with respect to one another transversely to the load direction in a non-loaded state.

15. The closure device as claimed in claim 1, wherein at least one of the magnetic poles of the first arrangement of magnets and the magnetic poles of the second arrangement of magnets are positioned together in rows along the load direction.

16. The closure device as claimed in claim 1, wherein at least one of the magnetic poles of the first arrangement of magnets and the magnetic poles of the second arrangement of magnets are arranged in rows together along a transverse direction which extends transversely to the load direction.

17. A textile closure for connecting textile parts, comprising a closure device as claimed in claim 1.

18. A closure device, comprising a first closure part which comprises a first surface with an arrangement of first structure elements arranged thereon and a second closure part which comprises a second surface with an arrangement of second structure elements arranged thereon, wherein the first closure part and the second closure part are to be positioned together in such a manner that the first surface of the first closure part faces the second surface of the second closure part such that the first structure elements and the second structure elements engage in one another in such a manner that movement of the closure parts in relation to one another along a load direction is blocked, wherein the first closure part comprises a first arrangement of magnets and the second closure part comprises a second arrangement of magnets, wherein at least one of the first arrangement of magnets is formed at least in portions by a permanent magnetic film having a plurality of magnetic poles which are offset to one another and have an alternating polarity along the first surface and the second arrangement of magnets is formed at least in portions by a permanent magnetic film having a plurality of magnetic poles which are offset to one another and have an alternating polarity along the second surface.

* * * * *